US005569983A

United States Patent [19]

McGuire et al.

[11] Patent Number: 5,569,983

[45] Date of Patent: Oct. 29, 1996

[54] ELECTRONIC APPARATUS FOR PRODUCING VARIABLE SPECTRAL OUTPUT

[75] Inventors: Kevin P. McGuire, Rochester; Richard E. Hagerman, Penfield, both of N.Y.

[73] Assignee: Tailored Lighting Inc., Pittsford, N.Y.

[21] Appl. No.: 291,168

[22] Filed: Aug. 16, 1994

Related U.S. Application Data

[63] Continuation-in-part of Ser. No. 216,495, Mar. 22, 1994.

[51] Int. Cl.[6] ..... G05F 1/00

[52] U.S. Cl. ..... 315/297; 315/307; 315/294; 315/314

[58] Field of Search ..... 315/297, 294, 315/291, 307, 314; 362/2, 27, 227, 236, 293

[56] References Cited

U.S. PATENT DOCUMENTS 4,968,927 11/1990 Pelonis ..... 323/243

5,144,190 9/1992 Thomas et al. ..... 313/113

5,175,477 12/1992 Grisson ..... 315/291

5,384,519 1/1995 Gotoh ..... 315/324

5,430,356 7/1995 Ference et al. ..... 315/291

*Primary Examiner*—Robert Pascal

*Assistant Examiner*—Haissa Philogene

*Attorney, Agent, or Firm*—Howard J. Greenwald

[57] ABSTRACT

An electronic apparatus for producing a wide variety of spectral outputs comprising at two dissimilar light sources, a source of alternating current, a means for specifying the desired spectral output, electronic means for varying the alternating current delivered to the first light source to produce a first spectral output, and electronic means for varying the alternating current delivered to the second light source to produce a second spectral output, which when combined with the first spectral output produces an overall light output meeting desired characteristics of illuminance and/or color temperature.

19 Claims, 15 Drawing Sheets

| Volts | ft-candles 314* | ft-candles 312* | ft-candles 310* | deg-K 314* | deg-K 312* | deg-k 310* |
|---|---|---|---|---|---|---|
| 0 | 1 | 1 | 2 | 4500 | 4500 | |
| 10 | 1 | 1 | 2 | 4550 | | |
| 20 | 1 | 2 | 2 | 4600 | | |
| 30 | 1 | 2 | 2 | 4600 | | 4500 |
| 40 | 1 | 2 | 2 | 4600 | 2320 | 4400 |
| 50 | 10 | 18 | 8 | 3840 | 2320 | 2770 |
| 60 | 38 | 54 | 24 | 4700 | 2320 | 2890 |
| 70 | 92 | 118 | 56 | 5500 | 2320 | 3120 |
| 80 | 172 | 215 | 99 | 6300 | 2520 | 3320 |
| 90 | 293 | 350 | 163 | 7200 | 2630 | 3530 |
| 100 | 450 | 529 | 245 | 8350 | 2730 | 3730 |
| 110 | 628 | 753 | 343 | 9700 | 2840 | 3920 |
| 120 | 861 | 1043 | 476 | 11500 | 2920 | 4100 |
| 130 | 1140 | 1376 | 630 | 15000 | 3010 | 4300 |
| 140 | 1350 | 1643 | 762 | 17000 | 3060 | |

FIG. 15 (A)

15A
15B

| Cond. Angle | ft-candles 314* | ft-candles 312* | ft-candles 310* | deg-K 314* | deg-K 312* | deg-k 310* |
|---|---|---|---|---|---|---|
| 30 | 2 | 2 | 1 | 4350 | 3430 | 3860 |
| 40 | 5 | 8 | 3 | 3620 | 2500 | 3100 |
| 50 | 20 | 28 | 10 | 4000 | 2180 | 2800 |
| 60 | 60 | 64 | 28 | 4800 | 2250 | 2940 |
| 70 | 140 | 151 | 64 | 5300 | 2360 | 3190 |
| 80 | 250 | 269 | 115 | 5950 | 2470 | 3400 |
| 90 | 365 | 410 | 185 | 7100 | 2600 | 3610 |
| 100 | 510 | 512 | 250 | 7800 | 2650 | 3770 |
| 110 | 636 | 675 | 308 | 8750 | 2730 | 3870 |
| 120 | 785 | 775 | 370 | 9500 | 2770 | 3950 |
| 130 | 868 | 896 | 418 | 10000 | 2800 | 4050 |
| 140 | 923 | 950 | 444 | 10500 | 2820 | 4100 |
| 150 | 930 | 970 | 450 | 11000 | 2822 | 4100 |
| 160 | 940 | 990 | 455 | 11000 | 2824 | 4100 |
| 170 | 950 | 1010 | 460 | 11000 | 2826 | 4100 |
| 180 | 960 | 1025 | 466 | 11000 | 2830 | 4100 |

* Light Source

FIG. 15(B)

15A
15B

350
+5V
366
373
375
C1
C2
VCC
74HC148
U1
A2
A1
A0
E0
GS
GND
E1
371
J1
MODJACK8F
368
370
372
380
10K
RP1
SW1
352
SW2
354
SW3
356
SW4
358
SW5
360
SW6
362
SW7
362
D

ELECTRONIC APPARATUS FOR PRODUCING VARIABLE SPECTRAL OUTPUT

CROSS-REFERENCE TO RELATED PATENT APPLICATION

This application is a continuation-in-part of copending patent application U.S. Ser. No. 08/216,495, filed on Mar. 22, 1994.

FIELD OF THE INVENTION

An electronic apparatus for reliably producing a wide range of variable spectral outputs.

BACKGROUND OF THE INVENTION

Many attempts have been made to simulate natural daylight by artificial means. Some of the more successful devices for this purpose are described in U.S. Pat. Nos. 5,079,683; 5,083,252; and 5,282,115. The entire disclosure of each of these U.S. patents is hereby incorporated by reference into this specification.

The apparatus of U.S. Pat. No. 5,282,115 is illustrative of these prior an devices. This apparatus contains a light source and a single filter. The single filter is comprised of a color correcting filter material and a neutral density filter material. As the apparatus is being adjusted, the spectral distribution of the light which passes through it varies continuously, but the brightness and/or illuminance of such light is substantially constant.

However, none of the devices of the above U.S. patents, and none of the prior art devices known to applicant, readily lend themselves for use in many commercial and residential settings. Thus, e.g., such prior art devices cannot readily be used in the dressing rooms of clothes stores, in jewelry stores, on the counters of cosmetic departments of department stores, in design studios, and the like.

U.S. Pat. No. 3,794,828 of Arpino discloses an appliance containing a plurality of incandescent lamps and makeup mirrors disposed in a portable case; some of the lamps are unfiltered, and some are provided with red filters. The lamps are so configured that the amount of power delivered to different lamps in the system may be varied, thereby varying the spectral outputs of such lamps.

In order for the appliance of the Arpino patent to function, it must utilize lamps with wattage ratings such that the wattage rating of one lamp is at least three times the wattage rating of another lamp. In many applications, where relatively high wattages are required, this three-to-one ratio is not feasible.

It is an object of this invention to provide an apparatus for controlling the illumination of two or more light sources, each with a different color temperature characteristic, so that the resultant color temperature produced is a blend of the color temperature of the individual sources and the desired color temperature and illumination will be reliably produced by the apparatus.

It is another object of this invention to provide an apparatus for controlling the illumination of two or more light sources, each with a different color temperature characteristic, so that the resultant color temperature produced is a blend of the color temperature of the individual sources and a range of desired spectral outputs and color temperatures can be produced with the device.

It is another object of this invention to provide an apparatus for controlling the illumination of two or more light sources, each with a different color temperature characteristic, so that the resultant color temperature produced is a blend of the color temperatures of the individual sources, and which apparatus can vary either the overall color temperature or the illuminance of the blend while holding the other relatively constant.

It is an object of this invention to provide an apparatus for controlling the illumination of two or more light sources, each with a different color temperature characteristic, so that the resultant color temperature produced is a blend of the color temperature of the individual sources, which apparatus is an electronic control unit and may be relatively inexpensive, lightweight and/or small in size.

It is an object of this invention to provide an apparatus for controlling the illumination of two or more light sources, each with a different color temperature characteristic, so that the resultant color temperature produced is a blend of the color temperature of the individual sources, which apparatus is especially suitable for use with a lamp with a coated reflector and light source which produces a spectral output which is substantially identical to daylight.

It is another object of this invention to provide an apparatus for controlling the illumination of two or more light sources, each with a different color temperature characteristic, so that the resultant color temperature produced is a blend of the color temperature of the individual sources, wherein said apparatus is comprised of a feedback system which monitors and stores in memory the spectral output and/or the illuminance of the device and makes necessary corrections to the power supplied to the light sources.

It is another object of this invention to provide an apparatus for controlling the illumination of two or more light sources, each with a different color temperature characteristic, so that the resultant color temperature produced is a blend of the color temperature of the individual sources, wherein said apparatus can be combined with prior art light booths to improve their reliability and output.

It is another object of this invention to provide an apparatus for controlling the illumination of two or more light sources which can store the illumination characteristics of the light sources and can be calibrated to operate the light sources at predetermined illumination and color temperature ranges.

It is another object of this invention to provide an apparatus for controlling the illumination of two or more light sources which do not necessarily need exact wattage ratios and by delaying the conductance and applied voltages to the light sources.

It is yet another object of this invention to provide an apparatus for controlling the illumination of two or more light sources which readily can be used in the dressing rooms of clothes stores, in jewelry stores, on the counters of cosmetic departments of department stores, in design studios, and the like.

SUMMARY OF THE INVENTION

In accordance with this invention, there is provided an electronic apparatus for producing a wide variety of spectral outputs. This apparatus is comprised of a first light source, a second, dissimilar light source, a source of alternating current, a means for specifying the desired spectral output, electronic means for varying the alternating current delivered to the first light source to produce a first spectral output, and electronic means for varying the alternating current delivered to the second light source to produce a second spectral output, which when combined with the first spectral output produces an overall light output meeting desired characteristics of illuminance and/or color temperature.

BRIEF DESCRIPTION OF THE DRAWINGS

The present invention will be more fully understood by reference to the following detailed description thereof, when read in conjunction with the attached drawings, wherein like reference numerals refer to like elements, and wherein:

FIG. 15 is a table of the data sets of conduction angles and their corresponding illuminance levels and color temperatures;

DESCRIPTION OF THE PREFERRED EMBODIMENTS

The first part of this specification will describe one preferred lamp unit, unit 10, which may be used in the claimed apparatus of this invention. Unit 10 is described and claimed in U.S. patent application U.S. Ser. No. 08/216,495, filed on Mar. 22, 1994, the entire disclosure of which is incorporated by reference into this specification. Thereafter, the claimed apparatus will be described.

Figure 1:
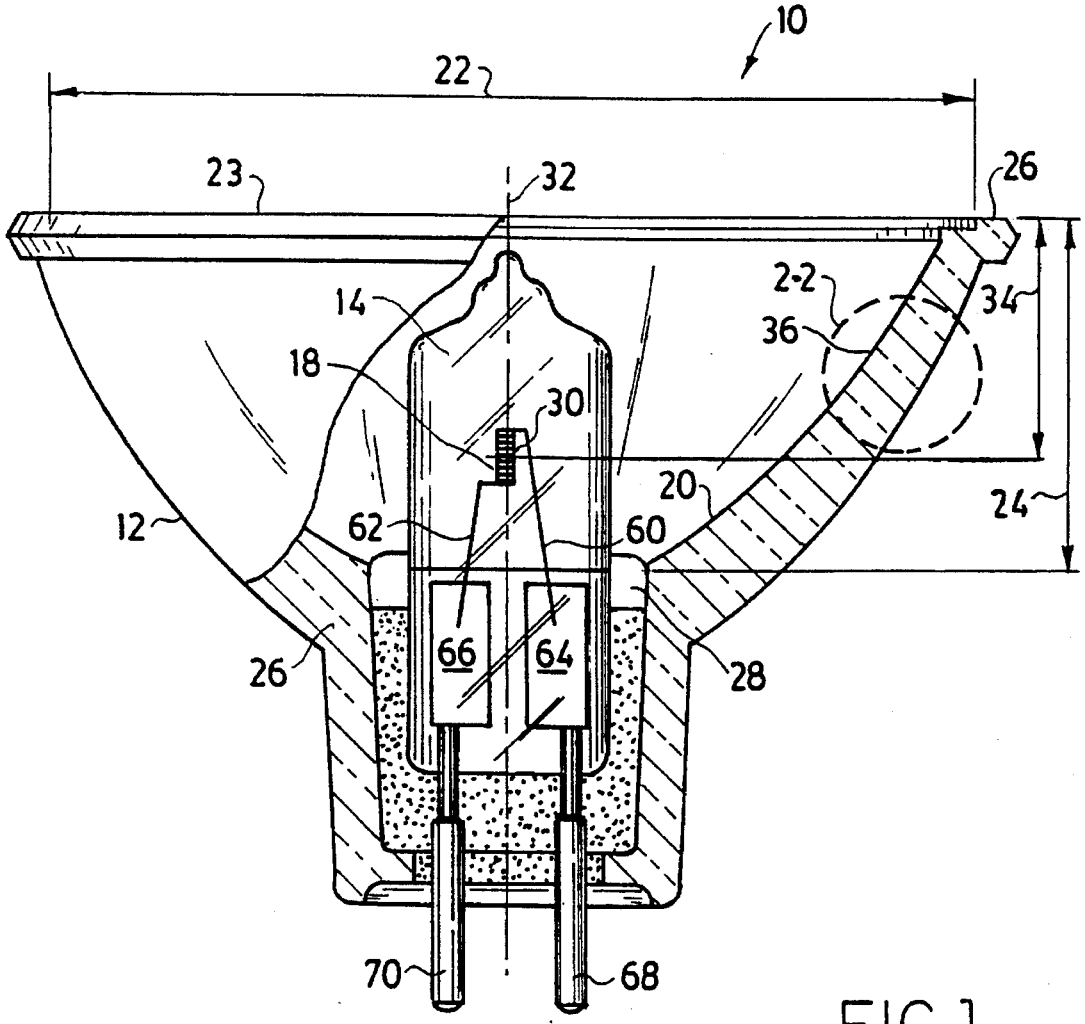
FIG. 1 is a sectional view of one preferred embodiment of a lamp assembly that can be used as part of this invention.

Referring to FIG. 1, which is a sectional view, lamp and reflector unit 10 is comprised of a radiant energy reflector 12, an incandescent lamp bulb 14 secured and mounted in reflector 12 through the base 16 of reflector 12, and a filament 18 disposed within lamp bulb 14. Filament 18 is connected via wires 60 and 62 to electrical connecting tabs 64 and 66, and thence to pins 68 and 70, which may be plugged into an electrical socket, not shown.

The reflector used in the lamp of the invention of co-pending application 08/216,495 preferably has certain specified optical characteristics. In the first place, the reflector body has a surface which intercepts and reflects visible spectrum radiant energy in the range of 400 to 700 nanometers. The filament 18 of bulb 14 used in the co-pending application's lamp assembly is so positioned within the reflector so that at least about 60 percent but preferably at least about 90 percent of the visible spectrum radiant energy is directed towards the reflector surface.

Furthermore, the reflector body has a coating on its surface from which the reflected radiance of each wavelength of the visible spectrum radiant energy directed towards the reflector surface when combined with the visible spectrum radiant energy not directed towards the reflector surface produces a total light output in substantial accordance with the following formula discovered and first disclosed in copending application U.S. Ser. No. 08/216,495:

$$R(1)=[D(1)-[S(1)\times(1-X)]]/[S(1)\times X],$$

wherein R(1) is the reflectance of the reflector coating for said wavelength, D(1) is the radiance of said wavelength for the daylight color temperature, S(1) is the total radiance of said filament at said wavelength, and X is the percentage of visible spectrum radiant energy directed towards said reflector surface.

The characteristics of reflector 12 are such that, on average, from about 80 to about 90 percent of all of the radiant energy with a wavelength between about 400 and 500 nanometers is reflected, on average, at least from about 50 to about 60 percent of all of the radiant energy with a wavelength between about 500 and 600 nanometers is reflected, on average at least about 40 to about 50 percent of all of the radiant energy with a wavelength between about 600 and 700 nanometers is reflected, and on average at least about 10 to about 20 percent of all of the radiant energy with a wavelength between about 700 and 800 nanometers is reflected. As shown in FIG. 1, the lamp assembly filament 18 is located at focal point 30, which is preferably located substantially below top surface 26 of reflector 12 such that the distance 34 between focal point 30 and top surface 26 is at least about 50 percent of the depth 24 of reflector 12 and, more preferably, is at least about 60 percent of the depth 24 of reflector 12.

As will be apparent to those skilled in the art, as the depth 24 of reflector 12 increases, the reflector 12 will increase the percentage of visible spectrum radiant energy which is intercepted by the reflector surface. Referring to the formula $R(1)=[D(1)-[S(1)\times(1-X)]]/[S(1)\times X]$, X will increase as the depth 24 of reflector 12 increases.

Figure 2:
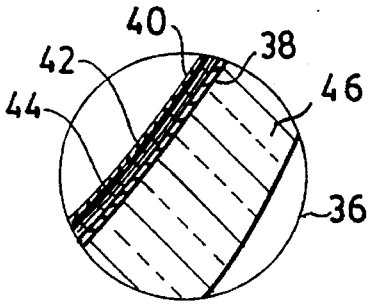
FIG. 2 is an enlarged sectional view of a portion of the reflector used in the assembly of FIG. 1.

Referring again to FIG. 1 and also to FIG. 2, it will be seen that filament 18 is a helical coil in shape with its longitudinal axis substantially aligned with and substantially parallel to axis of symmetry 32.

Reflecting surface 20 of reflector 12 is covered with a layer system 36 that is comprised of at least about five layers 38, 40, 42, and 44 which are coated upon substrate 46. Substrate 46 preferably consists essentially of a transparent material such as, e.g., plastic or glass. In one preferred embodiment, the substrate material is transparent borosilicate glass. As is known to those skilled in the art, borosilicate glass is a soda-lime glass containing approximately boric oxide which has a low expansion coefficient and a high softening point; it generally transmits ultraviolet light in higher wavelengths.

Although a minimum of at least about five such contiguous coatings must be deposited onto substrate 46, it is preferred to have at least twenty such contiguous coatings. In one preferred embodiment, each of layers 38, 40, 42, and 44 is a dielectric material (such as magnesium fluoride, silicon oxide, zinc sulfide, and the like) which has an index of refraction which differs from the index of refraction of any other layer adjacent and contiguous to such layer. In general, the indices of refraction of layers 38, 40, 42, and 44 range from about 1.3 to about 2.6. Each of the layers is deposited sequentially onto the reflector as by vapor deposition or other well know methods. It is preferred that, at different points on reflector 12, the thickness of the coatings system 36 varies and that such coating system 36 not have a uniform thickness across the entire surface of the reflector 12.

In accordance with the procedure described in copending patent application U.S. Ser. No. 08/216,495, reflector 12 is produced with a specified spectral output. The spectral output is calculated and determined with reference to the spectra of daylight, the spectra of the specific type of bulb 14 used in the lamp 10, as well as the position of bulb 14 within the lamp 10 and the percentage of its emitted light directed toward the reflector.

Figure 3:
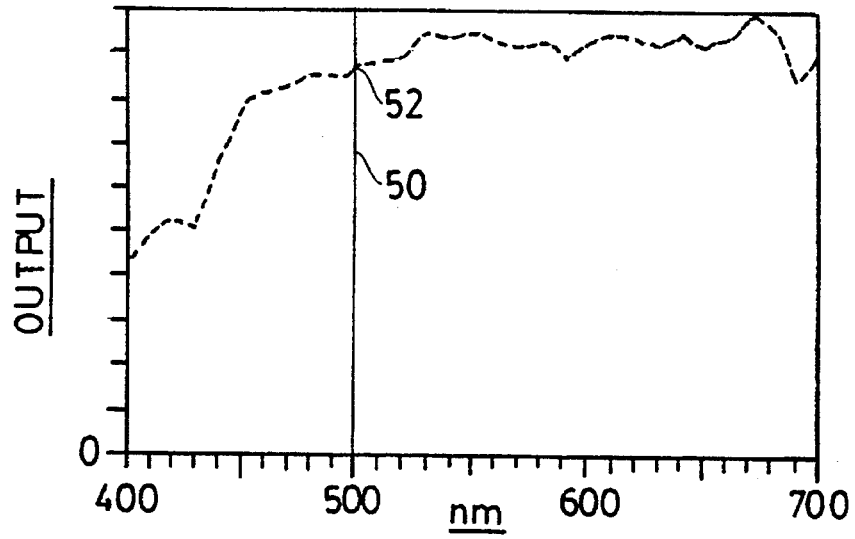
FIGS. 3, 4 and 5 are graphs, respectively, of an example of the spectra of daylight, an example of the spectral output of an incandescent lamp, and the reflectance of a reflector.
Figure 4:
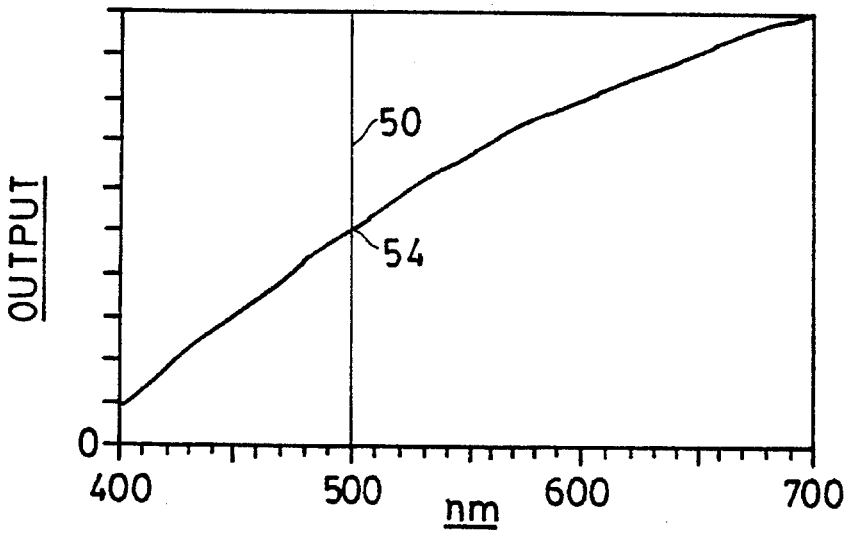

The spectra of daylight is well-known, and one example of such spectra is illustrated in FIG. 3. For any particular wavelength, the reflectance for reflector 12 at that wavelength can be determined for both the desired "daylight" and the characteristics of the lamp(s) used. Thus, referring to FIGS. 3 and 4, line 50 can be drawn at a wavelength of 500 nanometers to determine such radiances. Line 50 intersects the graph of the daylight spectra at point 52 and indicates that, at a wavelength of 500 nanometers, such daylight spectra has a radiance of 0.5 watts. Line 50 intersects the graph of the spectra of lamp 18 at point 54 and indicates that, at a wavelength of 500 nanometers, such lamp will have a radiance of 0.5 watts, assuming 100% of that wavelength of light that is emitted from the bulb is both directed toward and reflected by the reflector surfaces.

The reflector 12 is comprised of a reflector body with a coating on the surface of such body from which the reflected radiance of each wavelength of said visible spectrum radiant energy directed towards said reflector surface when combined with the visible spectrum radiant energy not directed towards said reflector surface produces a total light output in substantial accordance with the formula $R(1)=[D(1)-[S(1)\times(1-X)]]/[S(1)\times X]$, wherein R(1) is the reflectance of the reflector coating for said wavelength, D(1) is the radiance of said wavelength for the daylight color temperature, S(1) is the total radiance of said filament at said wavelength, and X is the percentage of visible spectrum radiant energy directed towards said reflector surface.

Figure 5:
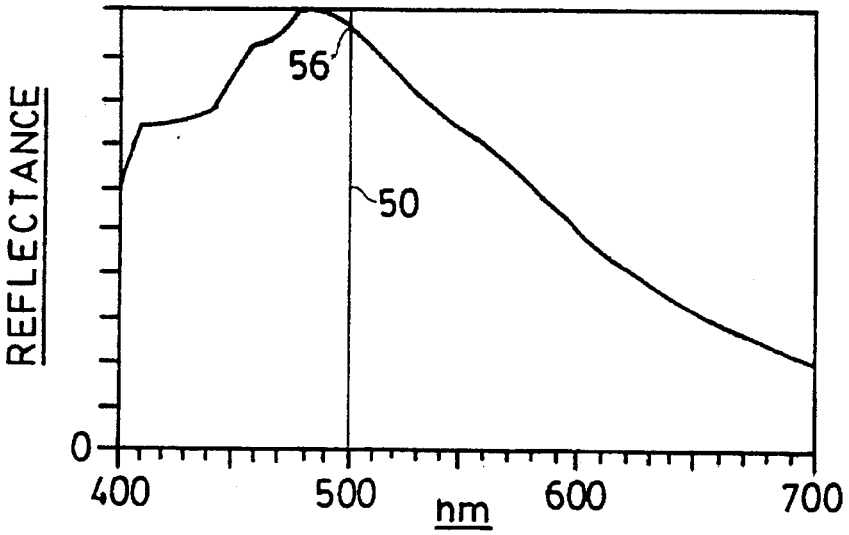

With the use of such formula, and for any particular wavelength, one can determine the desired reflectance for reflector 12. In the previous example, X=1 assuming 100% of the light is intercepted by the reflector, the equations simplified to $R\ \lambda=(D\ \lambda/S\lambda)=0.5/0.5=100\%$. At the 500 nanometer wavelength this value may be plotted at point 56 (see FIG. 5).

By such a method, for each wavelength, a graph can be constructed showing the desired reflectance for the reflector 12. Such a typical graph is shown as FIG. 5. It will be appreciated that FIGS. 3, 4, and 5, and the data they contain, do not necessarily reflect real values but are shown merely to illustrate a method of constructing the desired values for the reflector 12.

By way of illustration and not limitation, and in accordance with the aforementioned method, the desired reflectance values for a parabolic reflector with a borosilicate substrate were calculated at various wavelengths and for various conditions.

For each such wavelength, the radiant exitance is measured and presented for the specified source. As is known to those skilled in the art, the radiant exitance is the radiant flux per unit area emitted from a surface. The spectral characteristics of each light source are also influenced by its filament coil design, type of gas and fill pressure.

There are many companies skilled in the art which, when presented with a set of desired reflectance values at specified wavelengths, the substrate to be used, and the dimensions of the desired reflector, can custom design a coating for a reflector which, when coated, will have the desired shape and size and produce the desired reflectance values. Thus, by way of illustration and not limitation, such companies include Action Research of Acton, Mass., Bausch & Lomb Corporation of Rochester, N.Y., Evaporated Coatings Inc. of Willow Grove, Melles Griot Company of Irvine, Calif., Pennsylvania, OCLI Company of Santa Rosa, Calif., and Tyrolift Company Inc. of West Babylon, N.Y.

As is known to those skilled in the art, a multiplicity of daylight spectra exist. What characterizes all of such spectra, however, is that each of them contain a relatively equal amount of all colors across the spectrum.

Figure 6:
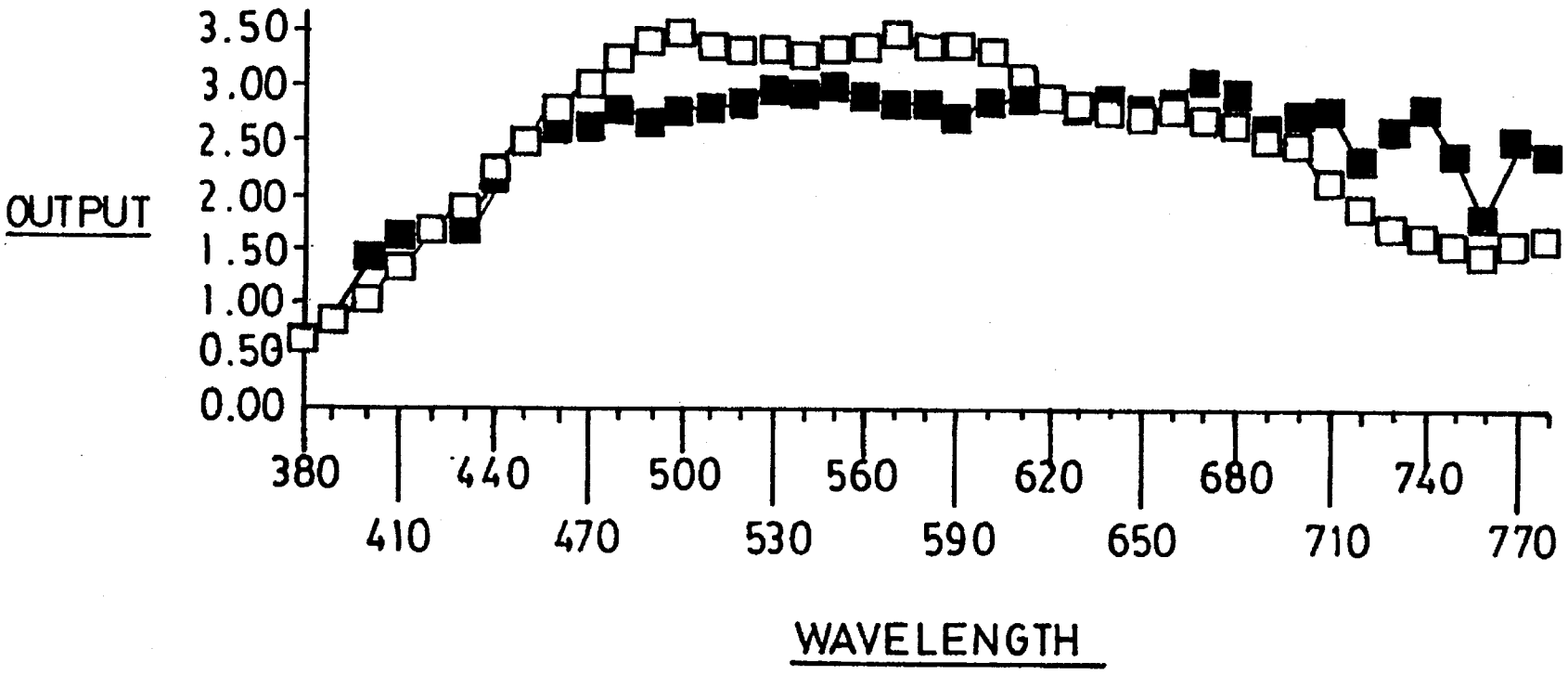
FIG. 6 is a graph of the actual output of a lamp assembly produced by copending application U.S. Ser. No. 08/2 16,495, as compared with actual daylight.

FIG. 6 is a graph of the output of a lamp assembly made with a reflector with the desired reflectance properties. For each wavelength, the output of daylight (black box value) and lamp 10 (white box value) were plotted. It will be noted that, across the spectrum, there is a substantial correlation between these values. The values are not identical, but they are substantially identical. Assuming at least a 90 percent of the visible light emitted from filament 18 is incident upon the reflector 12, the total light output of lamp 10 will comprise at least 50 percent of the visible light emitted by the filament 12.

As used in this specification, the term substantially identical refers to a total light output which, at each of the wavelengths between about 400 and 700 nanometers on a continuum, is within about 30 percent of the D(1) value determined by the aforementioned formula and wherein the combined average of all of said wavelengths is within about 10 percent of the combined D(1) of all of said wavelengths.

As will be apparent to those skilled in the art, an incandescent bulb may readily be produced with a specified filament and filament geometry by conventional means. Thus, e.g., one may use the method of U.S. Pat. No. 5,037,342 (quartz halogen lamp), 4,876,482 (a halogen incandescent lamp), and the like. It is preferred to orient filament 18 so that it is substantially parallel to the axis of rotation 32 of the reflector 12.

Bulb 14 preferably has a specified degree of illumination per watt of power used. It is preferred that, for each watt of power used, bulb 14 produce at least about 80 candelas of luminous intensity. As is known to those skilled in the art, a candela is one sixtieth the normal intensity of one square centimeter of a black body at the solidification temperature of platinum. A point source of one candela intensity radiates one lumen into a solid angle of one steradian.

Means for producing bulbs which provide at least about 80 candelas of luminous intensity per watt are well known to those skilled in the art. Thus, e.g., such bulbs may be produced to desired specifications by bulb manufacturers such as Sylvania Corporation.

It is preferred that the high-intensity bulb 14 be a high-intensity halogen bulb. Such high-intensity halogen light sources may be obtained from manufacturers such as Carley Lamps, Inc. of Torrance, Calif., Dolan-Jenner Industries, Inc. of Woburn, MAss., the General Electric Corporation of Cleveland, Ohio, Welch-Allyn Company of Skaneateles Falls, N.Y., and the like. Many other such manufacturers at listed on pages 467 –468 of " The Photonics Buyers'Guide," Book 2, 37th International Edition, 1991 (Laurin Publishing Company, Inc., Berkshire Common, Pittsfield, MASS.).

Referring again to FIG. 1, lamp assembly 10 is preferably comprised of a circular cover slide 23 which consists essentially of transparent material such as, e.g., glass, to cover the entire open end of reflector 12. Cover slide 23 is preferably at least about 1.0 millimeter thick and may be attached to reflector 12 by conventional means such as, e.g., adhesive. The function of cover slide 23 is to prevent damage to a user in the unlikely event that lamp assembly 10 were to explode. Additionally, if desired, cover slide 23 may be coated and, in this case, may be also be used to filter ultraviolet radiation.

Figure 7:
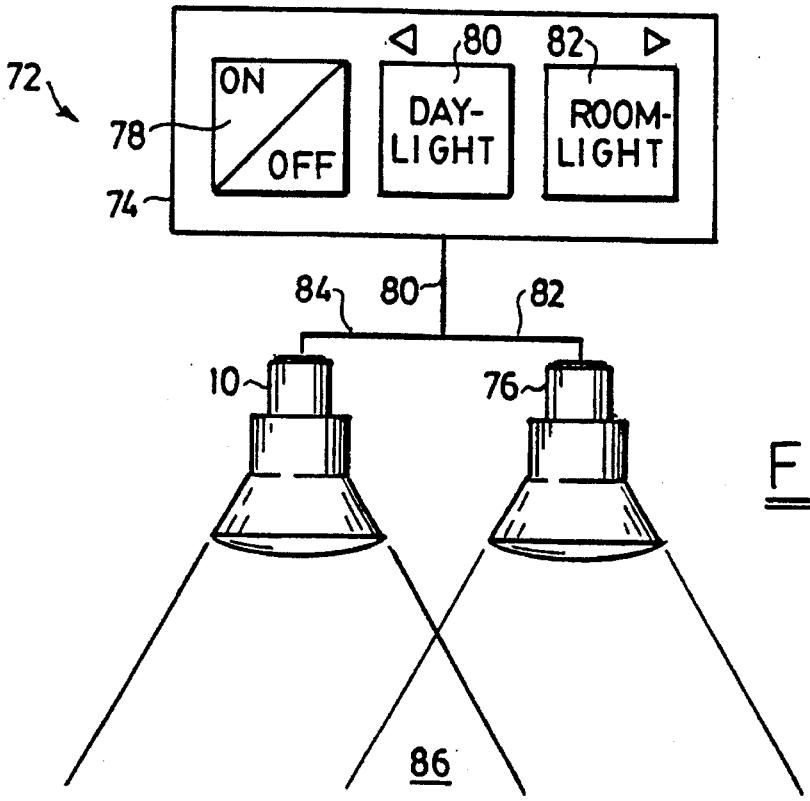
FIG. 7 is a schematic of a lighting assembly using the present invention.

FIG. 7 is a schematic representation of a lamp assembly using the instant invention. It will be seen that lamp assembly 72 is comprised of a controller 74 (to be described) which is electrically connected to both lamp 10 and lamp 76 by means of wires 80, 82, and 84.

Lamp 76 is preferably a standard incandescent lamp whose spectral output differs from that of lamp 10. These incandescent lamps are very well known to those skilled in the art and are described, e.g., in U.S. Pat. Nos. 5,177,396, 5,144,190, 4,315,186, 4,870,318, 4,998,038, and the like. The disclosure of each of these patents is hereby incorporated by reference into this specification.

In one embodiment, incandescent bulb 76 is an MR-16 bulb sold by the Sylvania Company with a color temperature of approximately 3,200 degrees Kelvin.

Although only one lamp 10 and one lamp 76 are illustrated in FIG. 7, many such lamps may be connected to and controlled by controller 74. The function of controller 74, which will be described in detail later in this specification, is to vary the amount of energy, and the time when such energy is delivered, which is passed from it to each of lamps 10 and 76. Thus, e.g., controller 74 is equipped with an on-off switch 78 to turn lamps 10 and 76 on and off, a daylight "ramp-type" switch 80, and a room light (or indoor) ramp-type switch 82.

Figure 8:
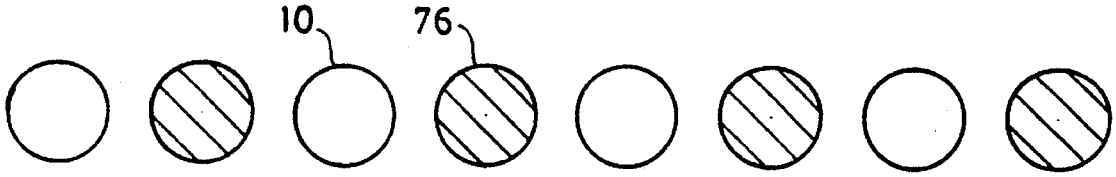
FIGS. 8 and 9 represent lighting assemblies comprised of multiple lamps in the assembly of FIG. 7.
Figure 9:
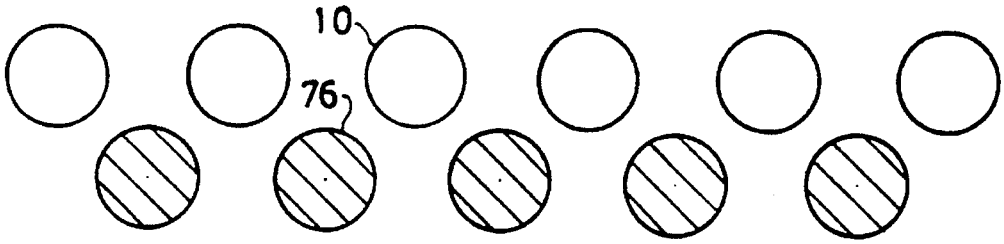

One arrangement of multiple lamps 10 and 76 is illustrated in FIG. 8, which comprises a dual-track low-voltage lighting system. Such lighting systems generally are well known to those skilled in the art. See, e.g., the Times Square Lighting catalog, which is published by the Sales and Manufacturing Division of Times Square Lighting, Industrial Park, Route 9W, Stony Point, N.Y. Another such arrangement of multiple lamps 10 and 76 is illustrated in FIG. 9, which comprises single track low-voltage lighting systems. Single track systems (see FIG. 9) are sold as products L002, L004, and L008 by this company. Dual track systems (see FIG. 8) are sold as products TS2002, TS2004, etc. by this company. Fixtures which can be used with either the single or dual track systems are sold Gimbal Rings (TL0121 ), Round Back Cylinders (TL0108), Cylinders (TL03 12), Asteroid (TH0609), and the like.

A Preferred Lighting System of this Invention

Although copending application U.S. Ser. No. 08/216,495 describes the use of prior art means for so controlling lamps 10 and 76, such as the means illustrated in U.S. Pat. Nos. 3,794,828, and 5,175,477, controller 74 of the invention of this application now will be described in full detail.

In one preferred embodiment, the lighting system of this invention is an electronic apparatus for producing a wide variety of spectral outputs. This apparatus is comprised of a first light source, a second, dissimilar light source, a source of alternating current, a means for specifying the desired spectral output and/or illuminance, electronic means for varying the alternating current delivered to the first light source to produce a first spectral output, and electronic means for varying the alternating current delivered to the second light source to produce a second spectral output.

In many respects, the lighting system of this patent application is similar to the lighting systems described in U.S. Pat. Nos. 5,079,683; 5,083,252; 5,282,115 and 5,329,435, the disclosure of each of which is hereby incorporated by reference into this specification. Each of the first two of these patents discloses an apparatus for continuously producing at least two spectrally different light distributions possessing substantially the same illuminance.

In U.S. Pat. No. 5,079,683, opto-mechanical means are provided for simultaneously varying the spectral distribution of light which passes through such means while maintaining the flux of such light at a substantially constant illuminance level. In U.S. Pat. No. 5,083,252, opto-mechanical means are disclosed for moving different optical filters in different directions, thereby changing the distance between such filters and the extent to which the filters interact with a beam of polychromatic light. In U.S. Pat. No. 5,282,115, an adjustable, opto-mechanical filter means comprised of a composite filter is provided.

The apparatus of the present invention as illustrated by controller 74 contains precise electronic means for controlling the output of at least two spectrally different light sources to achieve light distributions of predetermined, combined illuminance and/or spectral output levels. The process by which this is done is illustrated in FIG. 10.

Figure 10:
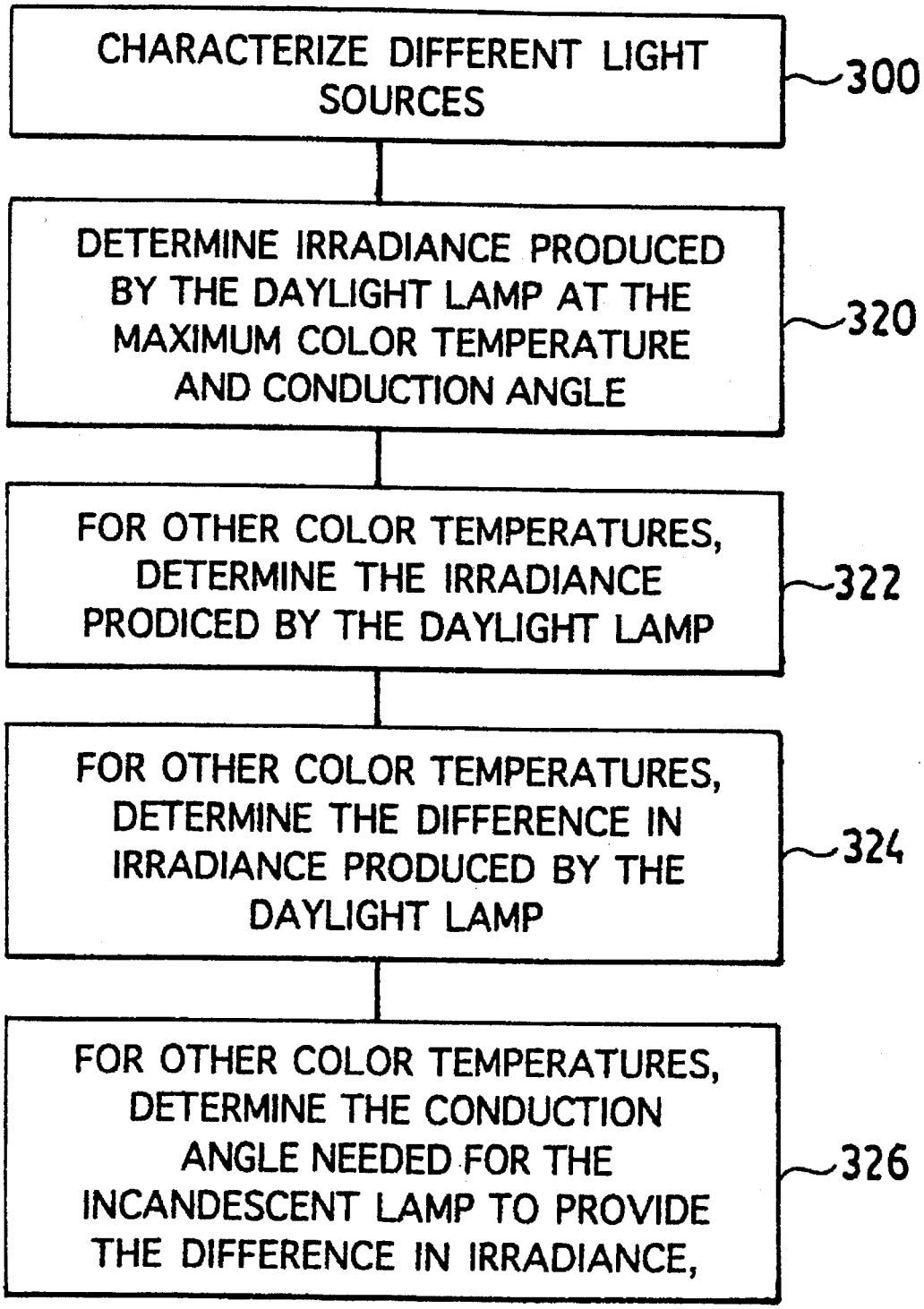
FIG. 10 is a flow diagram illustrating a preferred process for producing desired spectral outputs.

Referring to FIG. 10, and in the preferred embodiment illustrated therein, in step 300 of the process at least two different light sources (not shown) are characterized to determine their ranges of illuminance and color temperature values as will be described.

At least two of the light sources used in this process must be spectrally different. It is preferred that they have color temperatures which differ from each other by at least about 200 degrees Kelvin. Some of these light sources, and their optical parameters, are described in the aforementioned U.S. Pat. Nos. 5,079,683; 5,083,253; and 5,329,435 and in copending application U.S. Ser. No. 08/216,495.

In one preferred embodiment, the light sources used are full-spectrum, incandescent type of lamps. Thus, by way of illustration and not limitation, one may use a 150-watt, tungsten-halogen incandescent lamp as the lower temperature light source (which is available from MacBeth Corporation of Newburgh, New York as catalog number 20120029) and, in addition, a 750-watt tungsten halogen incandescent lamp (available from MacBeth Corporation as catalog number 20120027), which becomes the higher temperature light source by interjection of a color correction filter (available, e.g., from MacBeth Corporation as catalog number 29003013). In the remainder of this specification, and for the sake of simplicity of description, the 150 watt lamp will be referred to as the incandescent source and the 750 watt lamp/color correction filter combination will be referred to as the daylight source. It will be apparent to those skilled in the art that many other combinations of light sources may be used in the apparatus of this invention as long as the color temperatures of such sources differ by at least about 200 degrees Kelvin.

It is preferred that the daylight source have a color temperature of at least about 6,500 degrees Kelvin and, preferably, have a color temperature of from about 6,500 to about 8,000 degrees Kelvin. It is also preferred that the incandescent source have a color temperature of from about 2,100 to about 3,000 degrees Kelvin and, more preferably, from about 2,200 to about 2,400 degrees Kelvin.

Although reference has been made to two light sources, it will be apparent to those skilled in the art that three or more such light sources can be used. Additionally, or alternatively, one may use a multiplicity of light sources, one series of which is one type of lamp, and one series of which is another type of lamp. Other combinations and permutations of light sources will be apparent to those skilled in the art and are within the scope of this invention.

The apparatus used in the process of this invention will provide phase control for such light sources and will deliver alternating voltage power to such sources at different conduction angles and delay angles, depending upon the color temperature desired. The first step in the process is to characterize each of such light sources to determine, for a given conduction angle, what its illuminance and its color temperature will be.

Means for determining the conduction angle of alternating circuits are well known to those skilled in the art. Thus, by means of illustration and not limitation, one may refer to U.S. Pat. No. 4,968,927. By using that technique according to this invention, one may connect an oscilloscope in parallel with a light source and determine the illuminance and color temperature of the light source for each conduction angle. This is illustrated in FIG. 11, which is a circuit that may be used to characterize a light source to be attached to the apparatus of this invention.

Figure 11:
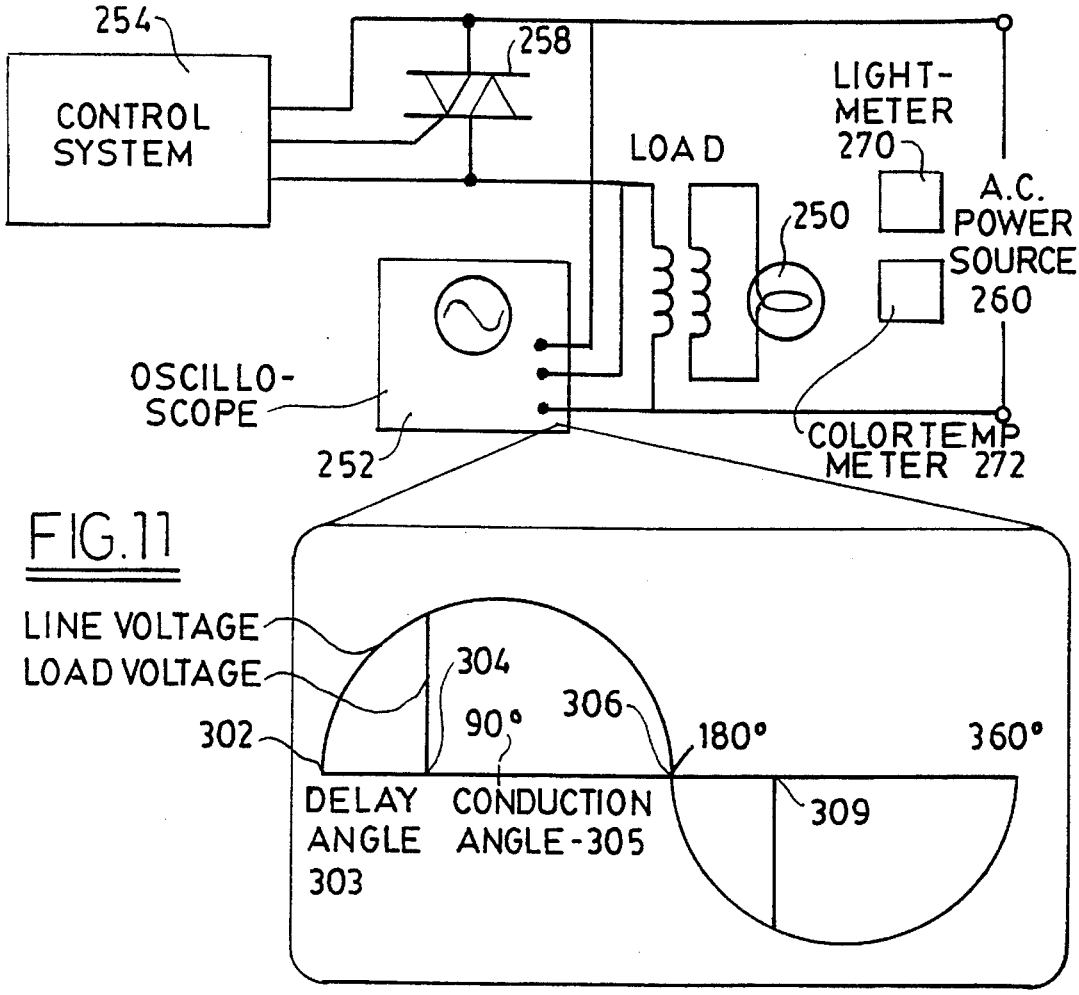
FIG. 11 is an oscilloscope circuit used to characterize, for any given light source, the delay angle and the conduction angle of applied voltage according to the invention to control the illuminance of the light source.

Referring to FIG. 11, the lamp 250 being characterized is connected in the circuit as the load to be measured by oscilloscope 252. A control system 254 as is known in the art controls thyristor 258 to cause a phase delay in voltage applied to the lamp load. It will be seen that, at point 302, although voltage from the alternating current power source 260 is being impressed across the circuit, current does not flow through the lamp 250 until a specified delay angle 303 has occurred. In the embodiment illustrated in FIG. 11, no current flows between points 302 (0 degrees) and 304 (30 degrees). Thus, in this example, the phase delay angle is 30 degrees. Details of the operation of the thyristor 258, phase control generally, and how effective voltage can be controlled can be found in well known reference texts, as for example THE THYRISTOR DATA MANUAL published by Motorola, Inc., copyright 1993 edition. See, for example, pages 1–2–8, 1–2–9, 1–2–15, and 1–3–14 through 17 of that publication. 381 The conduction angle 305 is equal to 180 degrees minus the phase delay angle and, in this example, is equal to 150 degrees; during this portion of the cycle, current flows through the light source (from points 304 to 306).

During the initial portion of the negative half of the voltage cycle (from points 306 to 309), current again does not flow through the light source; and, thus, the delay angle and the conduction angle for this negative half-cycle are 30 degrees and 150 degrees, respectively.

Figure 12:
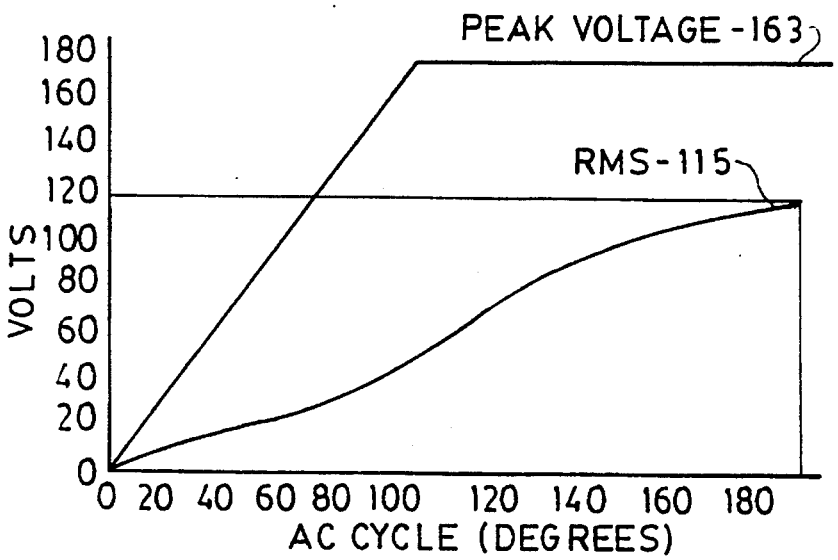
FIG. 12 shows the relationship of such angles with the Root Mean Square (RMS) value of the load voltage of FIG. 11.

As is known to those skilled in the art, the magnitude of an alternating current voltage is often refereed to as the magnitude of a direct current voltage that would produce the same heating effect. This is known as the Root Mean Square (RMS) of the alternating current voltage. FIG. 12 shows this relationship that exists between the conduction angle and the RMS value of the lamp load voltage of FIG. 11.

With changes in the conduction angle applied by the control system 254, since the RMS voltage is varied by the changes in the conduction angle, both the illuminance and color temperature of the light source will vary. Thus, one can determine, by using a light meter 270 that measures emitted light foot-candles and a color temperature meter 272 that measures the color of the emitted light in degrees Kelvin, both the illuminance levels and the color temperatures produced by a particular light source at various conduction angles within the voltage cycle can be read directly.

Figure 13:
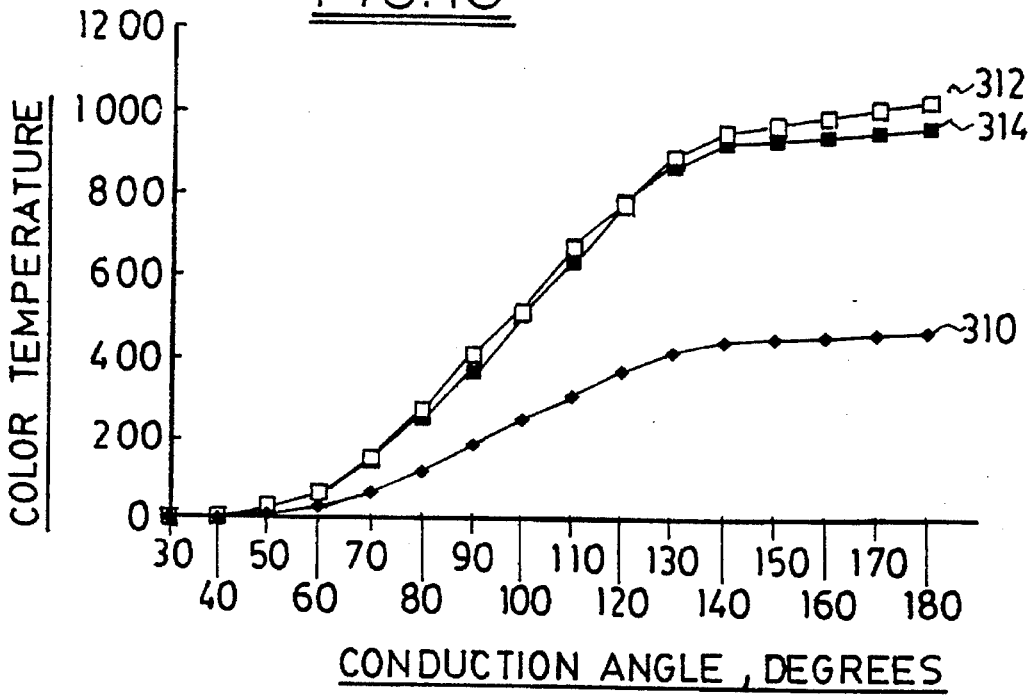
FIG. 13 is a graph of the illuminance of particular light sources, illustrating how it varies with the conduction angle of the voltage supplied to such light source.

FIG. 13 is a graph of the illuminances produced by three different light sources at different conduction angles. The three light sources evaluated were source 310 (the data for which is indicated by squares), source 312 (the data for which is indicated by circles), and source 314 (the data for which is indicated by crosses).

Figure 14:
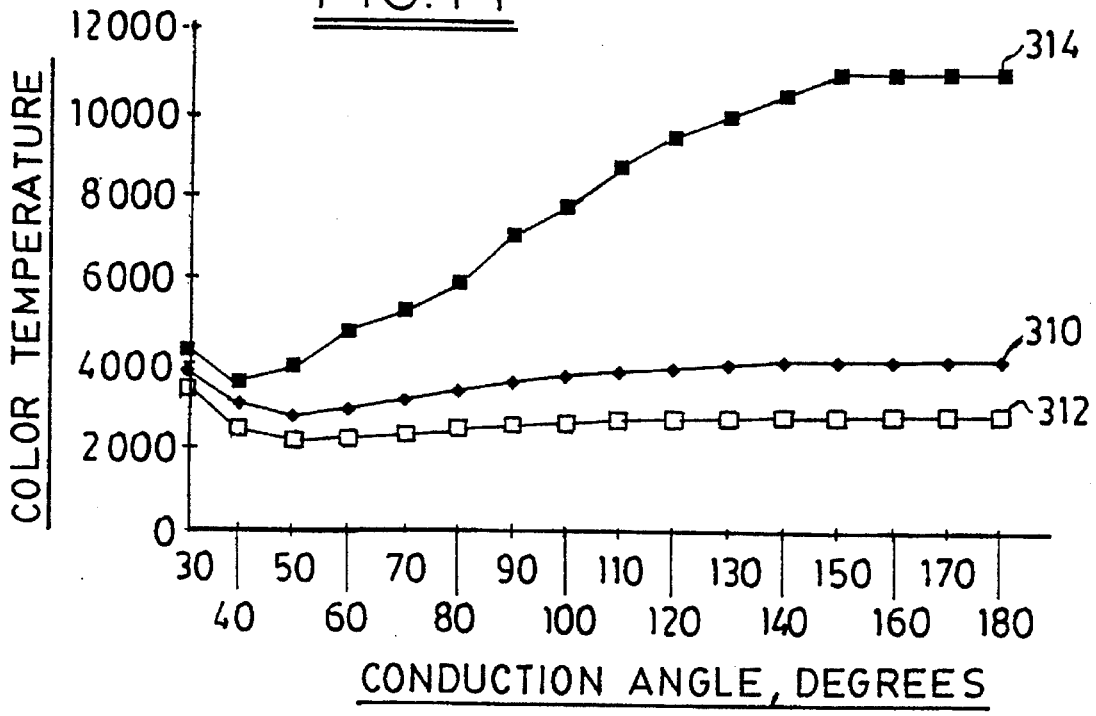
FIG. 14 is a graph of the color temperature of particular light sources, illustrating how it varies with the conduction angle of the voltage supplied to such light source.

FIG. 14 is a similar graph, illustrating the color temperatures for sources 310, 312, and 314 at different conduction angles. Using this data, tables such as that shown in FIG. 15 can be constructed correlating the conduction angles for a particular light source with both the illuminance of the source and its color temperature, which correlated data comprise data sets of delay or conduction angle/illuminance level/color temperature at each such measured angle. This is the process referred to in step 300 of FIG. 10.

Referring again to FIG. 10, in step 320, one then determines (by reference to the data generated for each light source), what conduction angle the "daylight" lamp should be supplied to provide the maximum desired color temperature for any particular application. As will be apparent to those skilled in the art, the daylight lamp is the lamp with the higher color temperature, and the number and/or sizes of the daylight lamps will determine the overall constant level of illuminance desired at that color temperature. In addition, the daylight lamp(s) may be capable of providing a color temperature even higher than the desired maximum by using a full conduction angle of 180 degrees, but for any given application a lower maximum may be desired.

In the next step of the process, step 322, one then determines (by reference to the portion of the table of data generated for that light source), the illuminance produced by the daylight lamp at color temperatures lower than the desired maximum color temperature and conduction angle.

For any color temperature lower than the desired maximum temperature, the illuminance produced by the daylight light source will be less than that at the maximum desired color temperature. Therefore, the other light source, or the incandescent lamp, will have to provide a finite amount of illuminance needed to make up the amount of illuminance lost by the daylight lamp because of its lower temperature output and smaller conduction angle. This difference in illuminance is determined in step 324.

The amount of illuminance needed from the incandescent lamp at any color temperature can be determined by reference to the tables (e.g., FIG. 15) and/or graphs (e.g., FIGS. 13 and 14). By referring to such data, one then can determine, in step 326, the conduction angle necessary to produce the desired amount of illuminance from the incandescent lamp at the specific color temperature. In addition, the overall color temperature of the combined light source can be read and added to the table or to a memory in the controller 74 by use of a feedback component as will be described so as to create a visual scale by which to set the conduction angles for any given composite color temperature.

A Preferred Controller for use in the Lighting System

In the remainder of this specification, a preferred controller for use in the claimed lighting system will be described. This controller preferably comprises an input switching device, a power supply, a microcontroller (comprising inputs and outputs sufficient to detect and decode switch depressions, zero crossing, and option jumpers, and also sufficient to interface with nonvolatile memory, a timer, an analog-to-digital converter with a four-channel multiplexer), an analog input circuit, non-volatile memory, switch output circuits, and lamp drivers.

In one preferred embodiment, one input to the microcontroller monitors 60 hertz power for zero crossings (which occur 120 times per second); the zero crossing is the time reference used for the phase delay angle and the conduction angle. Delaying the turn-on of the device by up to about 30 degrees has little effect on the intensity of most lamps. Delays between 30 and 150 degrees cause most lamps to dim. By 150 degrees most lamps are virtually dark, since delays between 150 and 180 degrees generally provide only about three percent of the total possible light. Of course, the invention can also be used in electrical systems other than 60 hertz, 110 volts alternating current, as for example the European standard of 50 Hertz, 220 volts AC, but the calculations would be based on other zero crossing frequencies and delay angles as appropriate, e.g. 100 zero crossings for a 50 hertz system.

The microcontroller's timer is started at the zero crossing. The frequency of the timer's clock is chosen to provide the required resolution between 30 degrees delay and 150 degrees delay. Thus, by way of illustration, to keep the timer value to eight bits, the number of clocks that the timer counts must be less than 256. There are preferably 120 degrees in the active control region (150 degrees minus 30 degrees). If the timer is restarted at 30 degrees, then the 120 degrees interval between 30 degrees and 150 degrees can be divided into 256 segments provided that the frequency of the timer clock is 46 kilohertz. The 8.33 milliseconds (the time it takes for one-half of the voltage cycle to occur) times 120/180 (the segment of the cycle during which current flows) divided by 256 (the number of desired segments) is equal to 21.7 microseconds, or 46 kilohertz.

Now the number of segments or steps that one wishes to ramp the lamps by their switches through the range of desired color temperatures is determined. Selection of the number of steps involves a compromise between the smoothness of transition between the color temperatures, the acceptable error in intensity and/or color temperature, and the amount of data and memory needed to accurately characterize and store the lamps over their full ranges. It is also important to insure that the time needed to make calculations and feedback adjustments can be provided for with the desired resolution.

Figure 16:
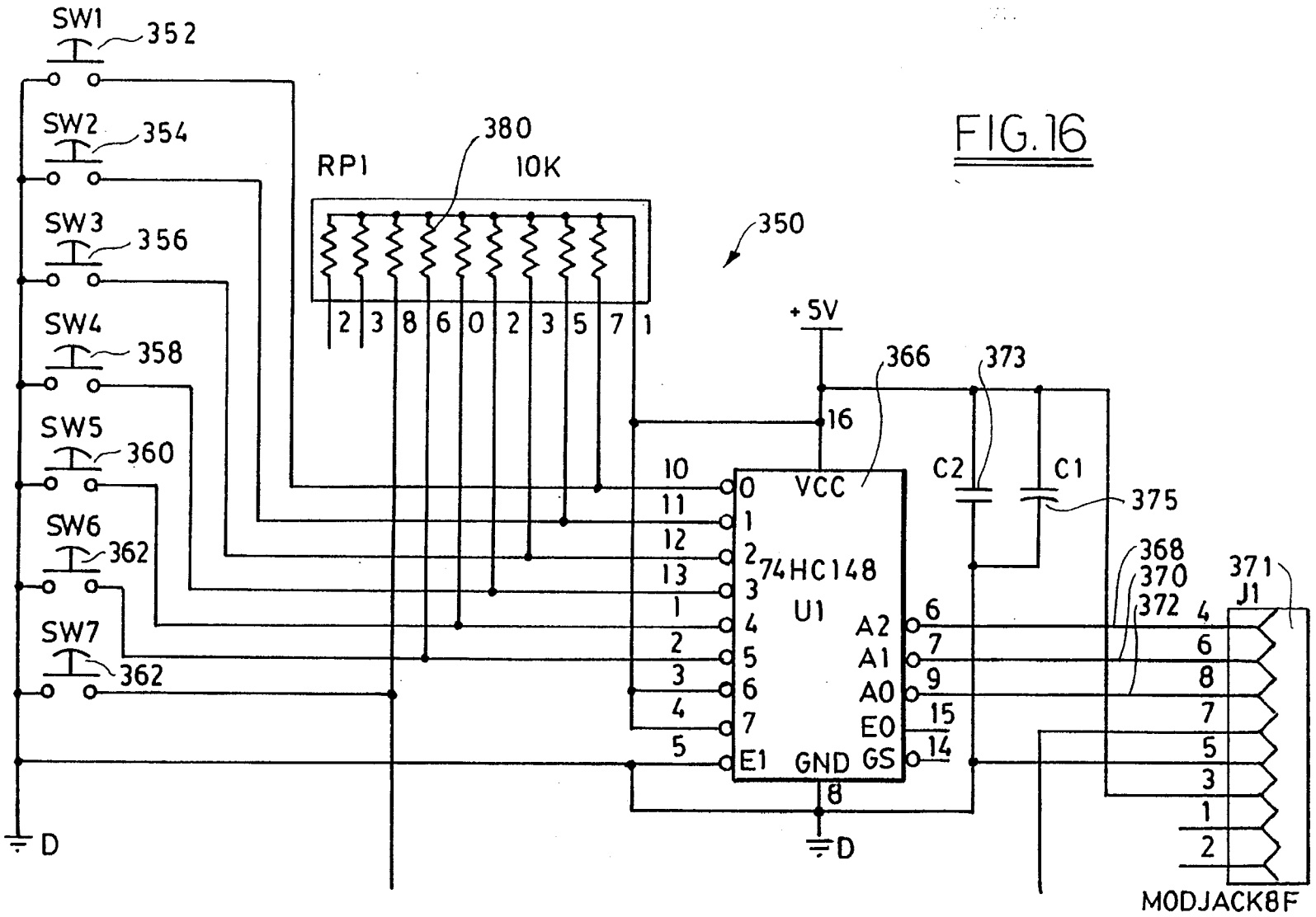
FIG. 16 is a schematic of an operator input device which may be used in conjunction with a preferred controller of this invention.
Figure 17:
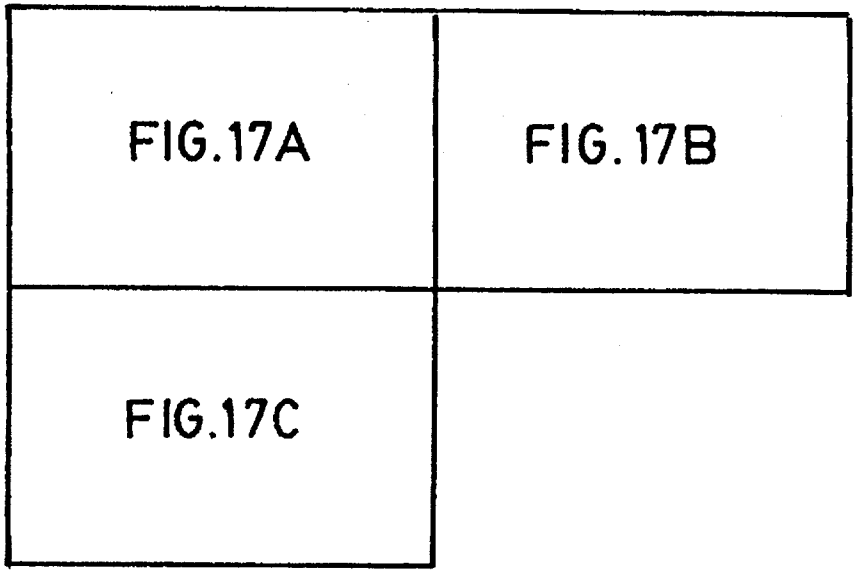
FIG. 17 is a schematic of a controller according to the invention, which will automatically adjust the power delivered to any two or more particular light sources to produce a spectral output of either constant illuminance and variable color temperature or constant color temperature and variable illuminance.
Figure 17A:
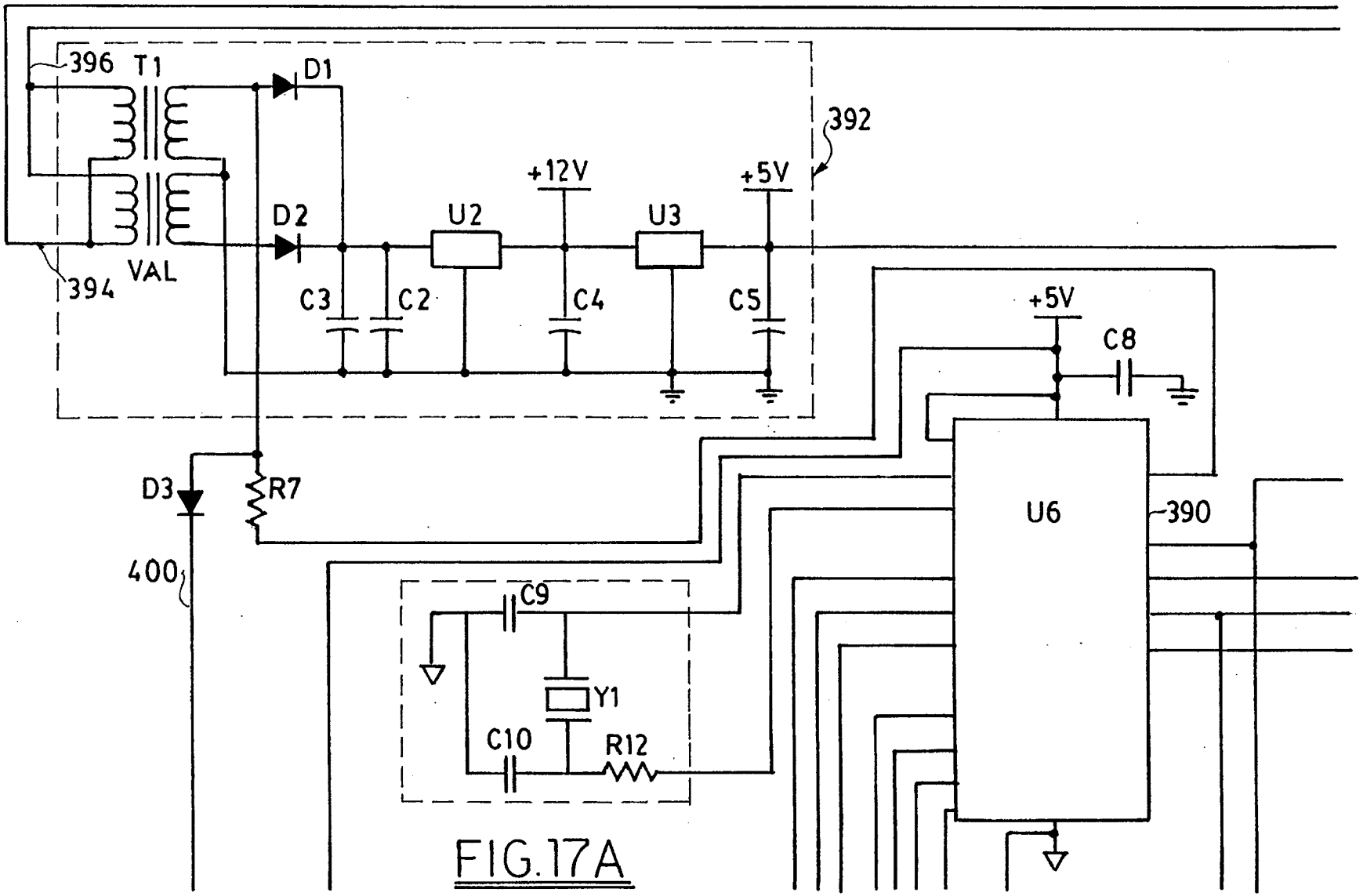
Figure 17B:
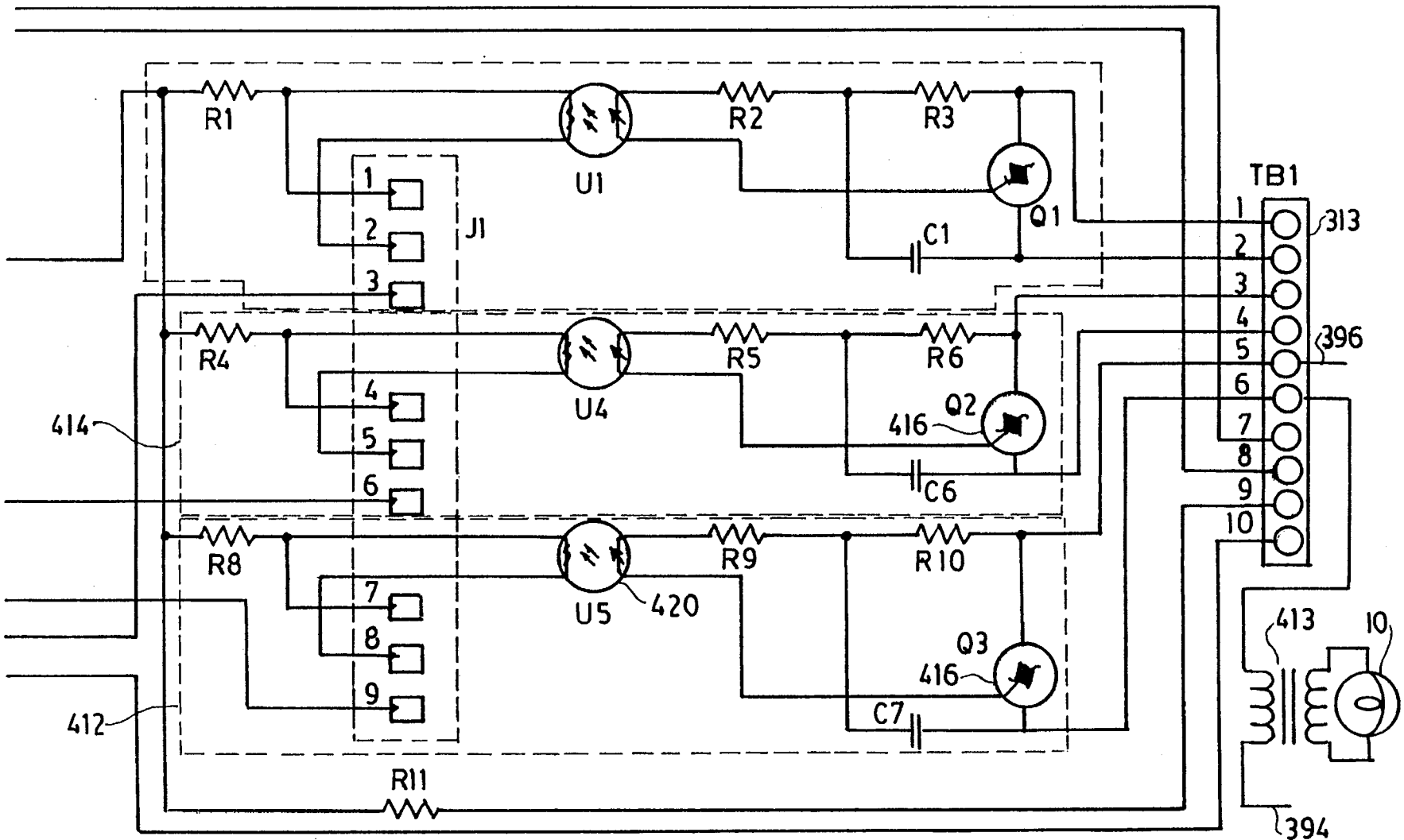
Figure 17C:
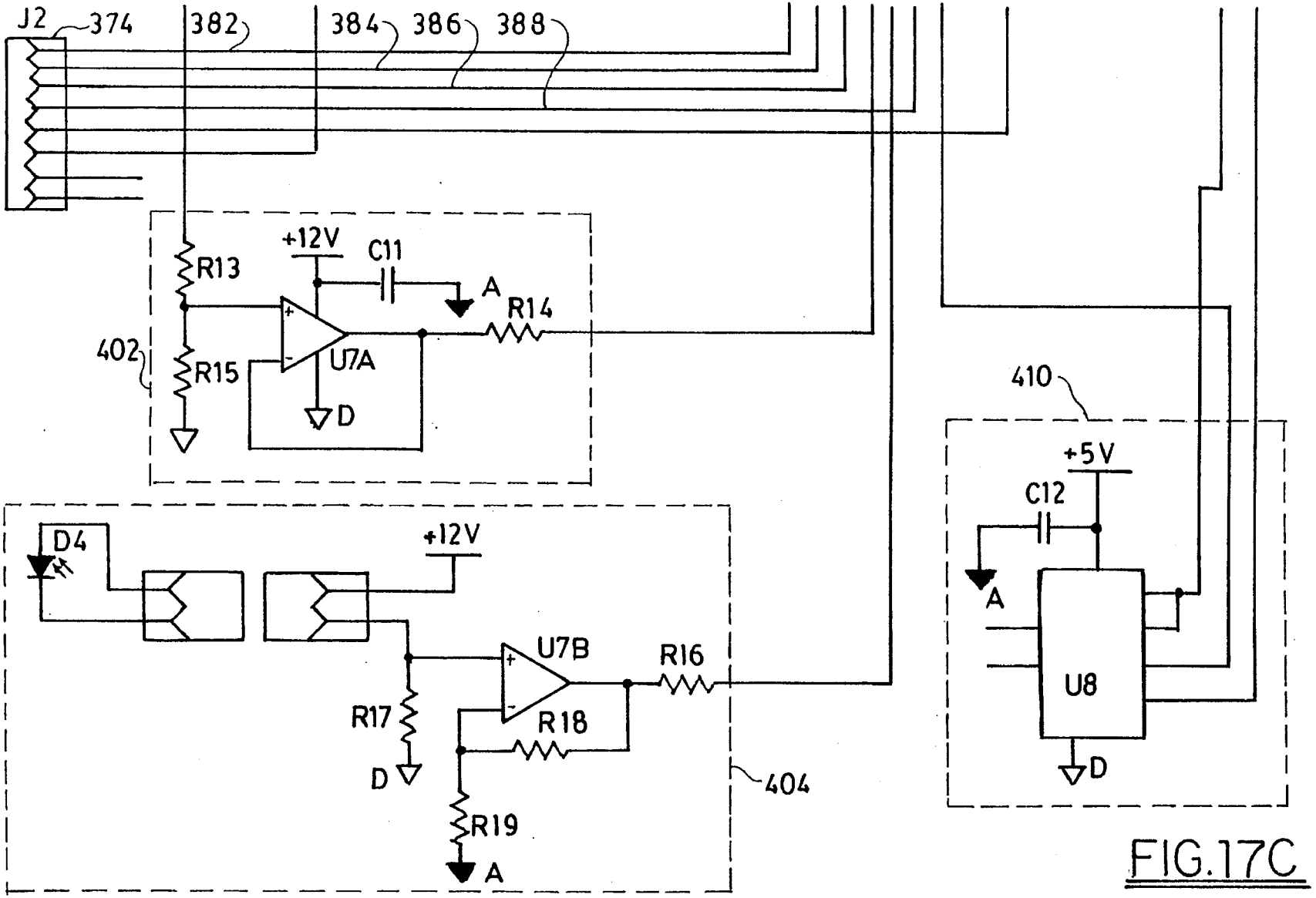

In the embodiment illustrated in FIGS. 16 and 17, a look-up table as in FIG. 15 was used to correlate the conduction angle of each lamp to the corresponding step of the ramp.

FIG. 16 is a schematic of one preferred input device 350 which may be used in the apparatus of this invention; in the preferred embodiment illustrated, input device 350 converts a key depression of any of the switches in the device into a three-bit digital code. As will be apparent to those skilled in the art, input device 350 by one or more of its switches allows a user to turn on or off one or more of the light sources in the lighting device. Additionally, input device 350 by others of its switches allows a user to vary the color temperature of at least a daylight light source and an incandescent light source. Furthermore, input device 350 has provisions to control other light sources in addition to the daylight light source and the incandescent light source, such as UV, cool white fluorescent, and/or "horizon" lights.

Referring to FIG. 16, it will be seen that input device 350 is comprised of a multiplicity of such switches 352, 354, 356, 358, 360, 362, and 364. Switches 352, 354, 356, 358, 360, and 362 are electrically connected to eight-line-to-three line priority encoder 366 which converts the input (key depression) from any one of such switches into a three-bit code and passes such code via lines 368, 370, and 372 to output jack 374. In the preferred embodiment shown, switch 352 represents the "on/off" button or switch, switch 354 represents the "daylight" button, switch 356 represents the "indoor" or "horizon" button, switch 358 the "CW" or cool-white fluorescent light bulb(s) switch, switch 360 the "UV" or ultraviolet light source, and switch 362 a "blank" switch available for future modifications to the apparatus. Each such input to priority encoder 366 has a corresponding resistor (see, e.g., resistor 380) to provide a signal when the switch to which it is connected is open.

Referring again to FIG. 16, capacitors 373 and 375 prevent the transmission of electrical noise to encoder chip 366. Switch 364 is an independent switch which is not connected encoder 366. This switch, representing the "store" switch and which is the functional equivalent of a shift key on a keyboard, may be used in conjunction with one or more of the other switches to calibrate the unit as will be described.

Referring to FIG. 17, the output from modular jack 374 is conveyed via lines 382, 384, 386, and 388 to microprocessor 390. Microprocessor 390 has several functions.

One function of microprocessor 390 is to decode the three-bit-digital code passed from modular jack 374 via lines 382, 384, 386, and 388. Software for performing this function will be described later in this specification.

Microprocessor 390 is connected to conventional power supply 392 which, in the embodiment illustrated, provides 12 volt direct current and 5 volt direct current to the circuit.

The input to power supply 392 is preferably 110 volt alternating current, which is fed to such power supply by lines 394 and 396. The alternating current voltage is stepped down to 12 volts in transformer 398, and the transformed 12 volt supply is then fed via line 400 to conditioning circuit 402, which scales the input voltage to a voltage level (generally about 5 volts peak alternating current) which can suitably be fed to microprocessor 390. In the preferred embodiment illustrated, the conditioning circuit 402 also provides an output impedance of about 10,000 ohms.

Referring again to FIG. 17, conditioning circuit 404 is also electrically connected to microprocessor 390 and is connected to light sensor 406 which measures foot-candles of light and is positioned within the apparatus to monitor the overall output of the lighting assembly. When the illuminance of the output sensed changes from the desired illuminance, the information is conveyed to microprocessor 390 which, in turn, adjusts the conduction angles of one or more of the light sources to correct the combined output illuminance and to restore it to its desired value. When the voltage of the input from light sensor 406 is too great for the microprocessor 390, circuit 404 will scale the input voltage to a level (usually about 5 volts peak alternating current) which the microprocessor 390 can safely handle.

Crystal oscillator assembly 408 provides the base frequency for the microprocessor 390.

Microprocessor 390 is also connected to nonvolatile memory circuit 410 which stores variable information regarding the light sources and their settings so that, when the power is turned off and on, the information is still available to microprocessor 390.

Referring again to FIG. 17, it will be seen that three lamp drivers are shown connected to microprocessor 390.

Lamp driver 412 is connected in series with a daylight lamp; and its output is conveyed via leads 5 and 6 to the daylight lamp, In the case of a lower voltage lamp such as lamp 10 described above, the driver is connected in series with the lamp's transformer 413 to step down the voltage from 110 volts AC to 12 volts AC. Lamp driver 414 is connected in series via leads 3 and 4 with the lower color temperature incandescent lamp or its transformer in the case of a lower voltage lamp.

In the preferred embodiment illustrated, each of the lamp drivers 412 and 414 is connected to microprocessor 390. Microprocessor 390 is connected to a conventional TRIAC opto-coupler 420 which is comprised of a light emitting diode and which, in response to the signal from the microprocessor, generates a light signal to activate the gate of the TRIAC and cause current to flow in the TRIAC 420. The output from opto-coupler 420 then is passed to TRIAC 416 (also referred to in this specification as thyristor 416). The thyristor 416 is operatively connected to lamp 10.

In the schematics of FIGS. 16 and 17, reference has been made using standard nomenclature to the electronic components of these preferred embodiments. The designations used are well known to those skilled in the art and are available from, e.g., in Newark Electronics catalog which was published by the Newark Electronics Company of Chicago, Ill. Reference also may be had, e.g., The Thyristor Data Manual published by Motorola, Inc., copyright 1993 edition of Tandy Electronics National Parts Division catalog published by Tandy Electronics of 900 E. North Side Drive, Fort Worth, Tex. More particularly, the microprocessor chip 390 and non-volatile memory 410 shown are available from Microchip Technology, Inc. of Chandler, Ariz., the optocouplers 420 from the Motorola Corporation of Schaumberg, Ill., and the lamp drivers 418 from Teccor, Electronics, Inc. of Irving, Tex..

The program imbedded in the microprocessor according to the invention is developed with commonly available software tools, as for example assembly language to write source code, a compiler to convert the source code to object code, and conventional means to load the program onto the microprocessor control chip portion, which has random access memory to handle the calculations while the apparatus is in operation, non-volatile memory to remember the various settings when the apparatus is off or in standby as well as recalibration, and either a programmable read-only memory (PROM) to receive the operating program during manufacture of the apparatus or an erasable PROM to permit both initial loading and field changes of the operating program.

The source code can easily be created by a computer programmer with normal skills in the programming art, once the operation of the apparatus as described above has been explained to the programmer. In essence, the operation would be based on key digital variables of the current switch settings as read from the nonvolatile memory, the base clock timer, a "debounce" timer to control voltage "bounce" that often is introduced when a switch is activated, a zero crossing bit for the alternating current lines to the lamps, the speed of the ramping of each of the illumination level switches to ramp up or down the illumination level of its corresponding light source incremented with the change in phase delay or conduction angle for that light source, a "scratch" location, a reading from the look-up table of the data sets of illuminance/color temperatures to match the ramping caused by pushing one of the light source switches, a reading of the desired INDEX for the other light source by calculating the necessary illumination component and determining the phase delay of the other light source by looking up the corresponding data set of illumination/color temperature for the other light source. The program components themselves would contain a START to power up and initialize all variables, configure the I/O ports and the prescaler which scales the basic microprocessor clock to the desired counter frequency. The sequence would contain repeats at 120 times per second which begin by turning off all outputs, wait until the alternating current achieves zero crossing, start the timer, operate the switch routine by reading which switch is pushed to increment indexing to the lookup tables at a rate determined by the ramp timer, and get from the lookup tables the phase delays or conduction angles, and turn on the corresponding lamp as soon as the timer value is greater than the phase delay for that lamp. The essential components of the program may, for example, be developed from the following program outline. Of course, the program will contain the normal lines of code to ensure that the various subroutines are complete and operate in the correct sequence and repeat cycles.

```
Key Variables
DAYLIGHT DELAY   EQU 7H    ;F7 DAYLIGHT PHASE DELAY
INDOOR DELAY     EQU 8H    ;F8 INDOOR PHASE DELAY
INDEX            EQU 9H    ;F9 INDEX into the delay
                           ;     time look-up table
SCRATCH          EQU OAH   ;F10 SCRATCH LOCATION
OLDSWITCH        EQU OEH   ;F14 LAST SWITCH VALUE
DBT              EQU OCH   ;DEBOUNCE TIMER
RT               EQU ODH   ;RAMP TIMER - sets ramp speed
OLDBIT           EQU OFH   ;F15 BIT 2 ZERO CROSSING
                           BIT
START
    Power up initialization;
        Initialize all variables and configure I/O ports,
        prescaler.
Repeat forever (repeats 120 times per second for 60 hertz)
Begin Turn off outputs
    Wait until zero crossing
    start timer
    do switch input routine
    get phase delay angle value from look-up tables
    if daylight delay is less than indoor delay
        do daylight
        do indoor
    if indoor delay is less than daylight delay
        do indoor
        do daylight
```

-continued

```
End
Endrepeat
Switch routine
if switches have changed
    start debounce timer
end if
return
if switches have not changed
    if debounce timer is running
        if debounce timer has not expired
            decrement timer
        end if
        return
        if debounce timer has expired
            if on/off button pushed
                change on/off status bit
            end if
            else if indoor switch pushed
                increment index to look-up tables at a rate
                    determined by the ramp timer (rt)
            end if
            else if daylight switch pushed
                increment index to look-up tables at a rate
                    determined by the ramp timer (rt)
            end if
        else decrement debounce timer
    end if
return
Indoor
    get phase delay angle from look-up table
    wait until timer is greater than phase delay
    turn on indoor lamp
    return
Daylight
    get phase delay angle from look-up table
    wait until timer is greater than phase delay
    turn on daylight lamp
    return
```

The apparatus according to the invention may be constructed to provide both (1) a relatively constant illuminance while changing color temperature from a predetermined high point to a predetermined low point and (2) illuminance variations from a predetermined low point to a predetermined high point while maintaining the color temperature at a relatively fixed level. The general principle of this preferred embodiment of the invention is generally illustrated by the graph in FIG. 18 plotting foot candles of illuminance against degrees Kelvin of color temperature.

Figure 18:
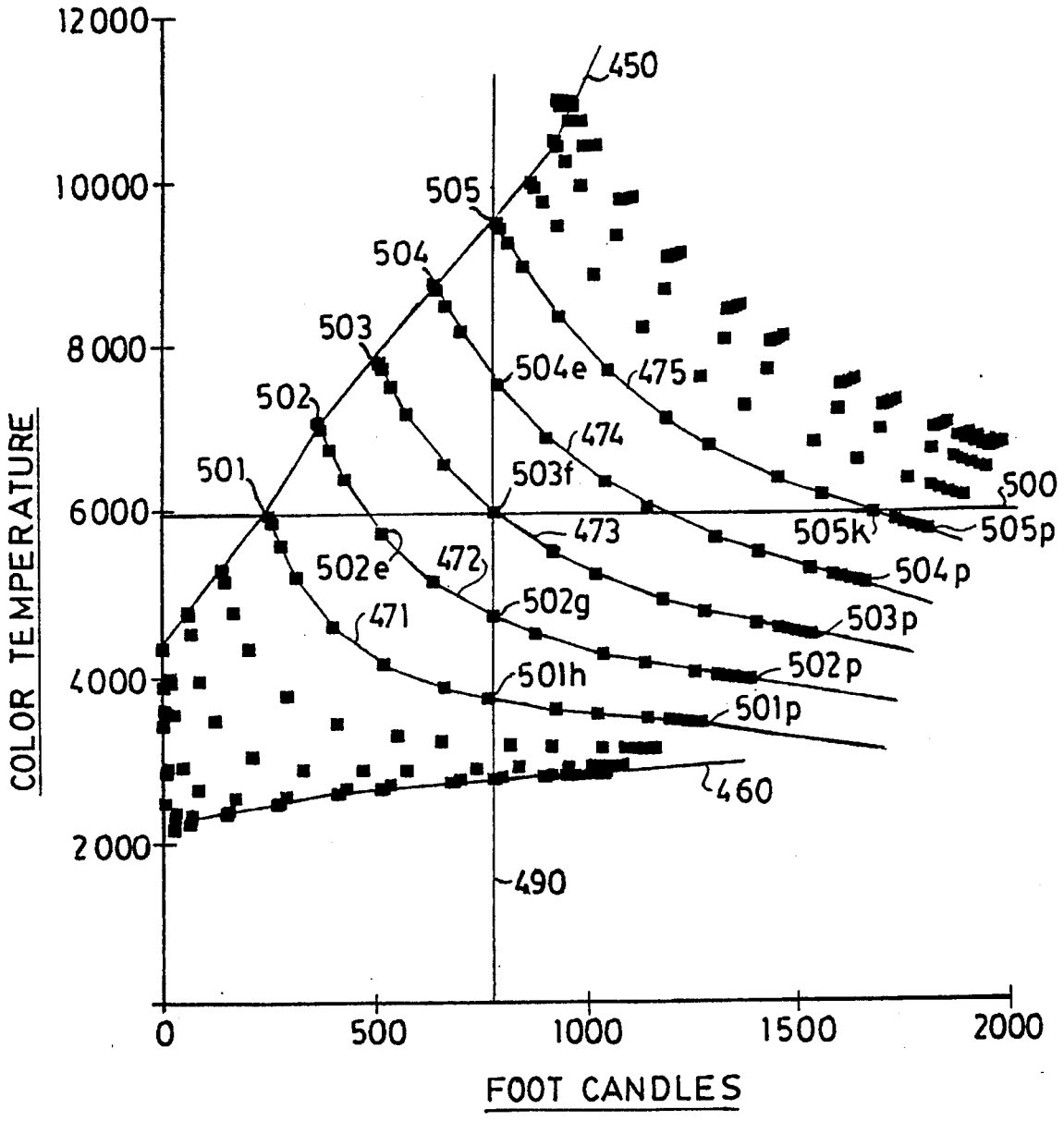
FIG. 18 is a another graph of characteristics of two light sources plotted to illustrate a method for programming a controller according to this invention in order to hold the color temperature relatively constant while varying the overall illuminance level.

FIG. 18 is a point plot of the light characteristics of the daylight lamp 314 (or group of such lamps) at sixteen (for simplicity) switch ramp stages at each of the conduction angles listed in FIG. 15, as shown by line curve 450 (the case when the incandescent lamp is off), the light characteristics of the incandescent lamp 312 (or group of such lamps) also at 16 switch ramp stages as shown by line curve 460 (the case when the daylight lamp is off), and all of the intermediate points of illuminance and color temperature of the combined light output of both lamps when both lamps are on at each of the different combinations of switch ramp stages (or conduction angles) for both lamps.

Referring again to FIG. 18, point 501 represents the light output when only the daylight lamp is on and its switch has been ramped to an intermediate position. Then at that daylight lamp output level, if the incandescent lamp is cycled through its ramp stages, the combined light output will be that shown by points 501*a* through 501*p* as shown by the curve 471 connecting those points. Similarly, as the ramping switch for the daylight lamp is moved to each of the successive stages 502 through 505, the corresponding curves of combined light output as the illumination of the incandescent lamp is increased is represented by the corresponding curves 472 through 475 connecting, respectively, points 502*a* through 502*p*, 503*a* though 503p, etc. For simplicity of illustration, only five such curves of light combinations are shown.

If the operating mode of relatively constant illuminance is selected, the appropriate switches (as will be described) are pressed to calibrate the apparatus for "constant illuminance" and set the non-volatile memory accordingly. The calibration mode will set the apparatus for the desired illuminance level using the daylight lamp, maximum desired color temperature, say at point 505 where the lamp is at 5900°K., and for which the relatively constant level of illumination is indicated by line 490. Then as the ramping switch is pushed to reduce the color temperature, the microprocessor cycles the bulbs though the combinations of data sets of the two lamps as fall closest to line 490, i.e., 504*e*, 503*f*, 502*g*, etc.

If on the other hand a relatively constant color temperature is desired, the appropriate switches (as will be described) are pressed to calibrate the apparatus for "constant color" and then operate the switches described above in the calibration mode to achieve the color temperature level desired by turning on only the daylight source and increasing the conductance angle to increase the illumination and reading the output of the color temperature feedback sensor until the desired color temperature, for example 5950° K. as shown by line 500, is reached. This is shown at point 501 in FIG. 18 and represents the minimum illuminance level at that constant temperature. In order to maintain the relatively constant color temperature 500, the computer program determines that if the illumination level of the daylight lamp is increased from point 501 to 502, the conduction angle for the indoor lamp is increased from its zero step "a" to step "e" to point 502*e* in order to restore the color temperature to that on line 500, which process is repeated as the illumination level of the daylight lamp continues to be increased.

We also have discovered that each of the points of the graph of FIG. 18 can be represented, in mathematical terms, by their x-value in foot candles F of the sum of foot candles of each lamp, or $F_{dc}+F_{ic}'$, where Fid is the illuminance of the daylight lamp d at a specific conduction angle c, and $F_{ic}'$, the illuminance of the incandescent lamp i also at a specific but not necessarily same conduction angle c'. Correspondingly their y-value in °K is very closely approximated by the weighted average of the color temperatures of the two lamps as determined by:

$$[(F_{dc})(°K_{dc})+(F_{ic}')(°K_{ic}')][F_{dc}+F_{ic}'],$$

where $(F_{dc})(°K_{dc})$ is the product of the color temperature °K $_{dc}$ of the daylight lamp at specific conduction angle c times the illuminance level $F_{dc}$, and $(F_{ic}',)(°K_{ic}',)$ is the product of the color temperature $°K_{ic}'$, of the incandescent lamp times the illuminance level $F_{ic}'$, at specific conduction angle c'. These mathematical equivalents of course can be used to create the computer program outlined above.

In the normal mode of operation, the user ramps between predefined calibration limits with a resolution up to a maximum of the predefined conduction angle increments of, e.g., 30 steps. The calibration mode allows the user to set the operating limits of the apparatus for user operation between two predetermined end points: either (a) predetermined high and low color temperature points at a relatively constant level of illuminance or (b) predetermined low and high levels of illuminance at a relatively constant color temperature.

The normal mode is entered by applying power with no push buttons depressed. Depressing the on/off switch 352 energizes the daylight and indoor lamps to produce the illuminance and color temperature at the level when the apparatus was last set. Depressing the daylight switch 354 or the indoor switch 356 causes the lamps to ramp along the characterized steps toward their high or low end points, respectively. Depressing the on/off button 352 alter operation will cause the lamps to turn off but with the final setting remaining stored in the non-volatile memory so that upon pushing the on/off button 352 again to restart the apparatus in the operating mode, the lights will be powered at that last setting. If supplemental light sources such as UV and/or cool white fluorescent lamps are used, the normal mode also allows for them to be separately energized by their switches 358 and 360.

To operate in a relatively constant illumination level, the calibration mode is entered by holding down the independent STORE button to activate switch 364 while the on/off. switch 352 is pressed to turn the apparatus on. A separate light indicator or one of the lamps is programmed to temporarily flash to indicate that the apparatus is in its calibration mode. Depressing the daylight button 354 to ramp the daylight lamp from a zero conduction angle toward its full conduction angle while reading the illuminance light meter 406 will enable the operator to stop at a desired predetermined constant illuminance that is then stored in the non-volatile memory by again pushing the store button 364 and the indicator lamp temporarily flashed. This further shifts the apparatus by its program to connect both the daylight switch 354 and the indoor switch 356 to operate both the daylight and indoor lamps according to their data sets to change the color temperature along, for example, line 490 toward higher color temperature by pushing the daylight button and a lower color temperature by pushing the indoor button 356. When, for example, a desired high end point of color temperature is reached at point 504*e*, the store button 364 is again pushed to set this end point in the non-volatile memory, and again pushed when a low end point, for example at 501*h* in FIG. 18, to set that point in the non-volatile memory. The apparatus is then turned off and on again by pushing only the on/off button 352 to now enable the apparatus to be operated in its operating mode along line 490 between points 504*e* and 501*h*.

To calibrate the apparatus to operate in a relatively constant color temperature, the on/off switch 352 is activated while both the store button 364 and daylight switch 354 are depressed. to signal the program to operate the lamps accordingly. After the indicator lamp has flashed (twice if desired to distinguish this mode from the previously described calibration mode) to indicate the calibration mode has been entered, depressing the daylight switch then increases the conductance angle of the daylight lamp from zero toward its maximum along line 450 until the desired color temperature is read by the meter 406, for example at point 501 on FIG. 18. After temporarily depressing the store button 364 to set this value in the non-volatile memory, the program then sets daylight switch 354 and indoor switch 356 to operate both lamps from a minimum illuminance at point 501 toward a maximum illuminance along line 500 to, for example, point 505*k*. Pressing the store switch 364 again sets this limit in memory. The calibration mode is left by again depressing the on/off switch which will turn off all lamps to indicate that the calibration mode has been left. Upon restarting the apparatus by depressing only the on/off switch, the apparatus will then operate at a relatively constant color temperature along line 500 toward low illuminance end point 501 by pushing the daylight switch 354 and toward the high illuminance end point 505*k* by depressing the indoor switch 356.

All of the foregoing steps when described to a programmer with ordinary skill will be able to build upon the computer program outlined above to enable these operations to take place in the sequence described.

As suggested above, light sensor 406 is positioned not only to measure overall illuminance, but also may include a color temperature sensor as is well known in the art in order to provide to the user a direct reading of the color temperature either as a visual reference and/or to introduce the readings into the non-volatile memory of the microprocessor to supply the microprocessor with the color temperature readings to be used with the corresponding conduction angles in the data sets. Such a color temperature sensing device may be composed of two spectrally biased sensors, one detecting light primarily in the 400 nm to 500 nm portions (blue light) of the visible spectrum and the other sensor detecting light in the 700 nm to 780 nm range (red). Such two sensors as is well known in the art can be used to monitor the overall color temperature and foot candles of the combined light sources and the output of which can be used in the feedback circuit. Alternatively, light sensor 406 may use the photovoltaic system included in the MINOLTA XY1 light meter which normalizes the readings from three different light responsive cells each covering a portion of the visible light spectrum and which displays both illuminance and color temperature, but in lieu of a scaled meter readout the normalized analog voltage outputs are connected as feedback to the microcontroller and convened to digital information to be used as a reference to alter the phase angles as described above.

Thus, if the light source characteristics should change over time, or new lamps are inserted, or if a revised characteristics are preferred, the lamps can be recharacterized by the controller apparatus simply by programming in a scanning procedure that sequences the conduction angles of both lamps through all of their combinations and by the feedback light sensor 406 measuring both illuminance and color temperature at each such combination to reset the corresponding values in the look-up tables. One further can provide that the feedback circuit include the illumination level meter 406 in the operating mode, in addition to manual readout, to measure continuously the levels of illuminance and adjust the data sets accordingly, so that the effects of light source aging can be corrected in the tables without requiring recalibration.

It also is possible to use a point plot of two or more lamp types, as in FIG. 18, to design for others specific lighting systems with specific desired properties and limitations, for example by creating the plot using a finite number (two or more) of each lamp type and plotting all permutations of all lamp combinations at all conduction angle stages, applying an overlay of the desired high and low limits of illuminance and color temperature of the lighting system to be produced (which overlay may be rectilinear, oval or any other two dimensional shape), and then determining from the point plot which of the lamp combinations are needed to fill the desired light space.

In addition, if any supplemental light source such as the cool white fluorescent light source is included, its light output of course would also be read by the light sensor 406 and its computed value of illuminance read into the non-volatile memory to modify the data set values by a factor computed by the microprocessor to determine the finite amount of illuminance otherwise required by the incandescent indoor lamp to maintain the constant level of illuminance or color temperature, as desired.

It is to be understood that the aforementioned description is illustrative only and that changes can be made in the apparatus, in its components and their properties, and in the sequence of combinations and process steps, as well as in other aspects of the invention discussed herein, without departing from the scope of the invention as defined in the following claims.

We claim:

1. Apparatus for continuously producing a predetermined light characteristic from at least two spectrally different light sources, wherein a first of said light sources emits light at one range of color temperatures and a second of said light sources emits light at a different range of color temperatures, the apparatus comprising first means for changing the illumination output of said first light source, second means for changing the illumination output of said second light source, and electronic controller means comprised of means programmed to establish a desired light characteristic using said first light source, microprocessor means to establish the levels of illumination and color temperature of said first light source as the first illumination changing means changes the illumination level of said first light source, wherein said microprocessor means calculates the amount of illumination needed from said second light source to restore the overall light to the desired characteristic, and wherein said apparatus further comprises light control means to set the level of illumination of said second light source to such calculated amount.

2. The apparatus as recited in claim 1, wherein the second light source is excited by alternating current with a half cycle of 180 degrees, and said light control means comprises a lamp driver to delay the application of voltage to the second light source until a predetermined angle within each half cycle is reached.

3. The apparatus as recited in claim 2, wherein the microprocessor means to calculate the level of illumination includes a data base containing data sets of illuminance levels and corresponding color temperatures of the second light source at predetermined levels of illumination of the second light source as changed by the second changing means, and the predetermined angle is calculated by reference to the data sets.

4. The apparatus as recited in claim 2, wherein the lamp driver includes a TRIAC opto-coupler comprising a gate to control the application of voltage to the second light source at the predetermined angle, and a light emitting diode to generate a light signal in response to input from the microprocessor to activate the gate at the predetermined angle.

5. The apparatus as recited in claim 1, wherein the desired characteristic is a relatively constant level of illumination, and the microprocessor means to calculate the level of illumination includes a data base containing data sets of illuminance levels and corresponding color temperatures of both the first and the second light sources at predetermined levels of illumination of each of the light sources as changed by their corresponding changing means, and the calculated amount is determined from the data set by locating the amount of reduced illuminance from the maximum predetermined illumination level of the first light source at the corresponding setting of the first changing means, and determining by reference to the data set the amount of total illuminance needed from the second light source to restore the combined illumination level of both light sources to the maximum predetermined level of illumination of the first light source.

6. The apparatus as recited in claim 1, wherein the desired characteristic is a relatively constant level of color temperature, and the microprocessor means to calculate the level of illumination includes a data base containing data sets of (a) the illuminance level and corresponding color temperature of the first light source at predetermined levels of illumination of the first light source as changed by its changing means, (b) the illuminance level and corresponding color temperature of the second light source at predetermined levels of illumination of the second light source as changed by its changing means, and (c) the combined color temperatures and illuminance levels of both lamps for all illumination levels of the second light source at each predetermined level of illumination of the first lamp source, and the calculated amount is determined from the data set by locating the color temperature of the first light source at the corresponding setting of the first changing means, and determining by reference to the data set the amount of total illuminance needed from the second light source to restore the combined color temperature of both light sources to the predetermined level.

7. The apparatus as recited in claim 1, and further comprising feedback circuit means to measure the actual levels of illuminance from the light sources and to adjust the calculated amount as needed to maintain the overall illumination level at the level for the first light source at its desired maximum color temperature.

8. Apparatus for continuously producing a relatively constant level of a light characteristic selected from one of a relatively constant illumination level and a constant color temperature, comprising:

a first light source that emits light at predetermined color temperatures at varying illumination levels, a second light source that emits light at color temperatures different from that of the first light source also at varying illumination levels, first means for changing the illumination level of the first light source, second means for changing the illumination level of the second light source, means to establish a predetermined illumination level of one of the light sources at a desired light characteristic level, means to establish the levels of illumination and color temperature of each of the light sources at predetermined intervals as its corresponding changing means changes its illumination level, microprocessor means to receive data representing the value of a desired light characteristic and to calculate the amount of illumination needed from each of the light sources to maintain the predetermined level of light characteristic relatively constant, and driver means to control the illumination changing means for each of the light sources to emit illumination from light source at the calculated amount.

9. The apparatus as recited in claim 8, wherein the light sources are excited by alternating current with a half cycle of 180 degrees, and said light control means comprises a lamp driver for each such light source to delay voltage to that light source until a predetermined angle within each half cycle is reached.

10. The apparatus as recited in claim 9, wherein the lamp driver for each light source includes a TRIAC opto-coupler comprising a gate to control the application of voltage to the corresponding light source at the predetermined angle, and a light emitting diode to generate a light signal in response to input from the microprocessor to activate the gate at the predetermined angle.

11. The apparatus as recited in claim 8, and further comprising feedback circuit means to measure the actual levels of at least one of the characteristics selected from the illumination level and the color temperature of the combined light sources and to adjust the calculated amount as needed to maintain the characteristic to that of the first light source at its predetermined constant level.

12. The apparatus as recited in claim 8, wherein the microprocessor means to calculate the levels of illumination includes a data base containing data sets of illumination levels and corresponding color temperatures of the light sources at the predetermined levels of illumination of the light sources, and the calculated amounts are determined by reference to the data sets.

13. The apparatus as recited in claim 12, wherein the characteristic selected is a relatively constant illumination level, and the calculated amounts are determined by locating in the data sets the amount of reduced illuminance from the maximum predetermined illumination level of the first light source at the corresponding setting of the first changing means, and determining by reference to the data sets the amount of total illuminance needed from the second light source to restore the combined illumination level of both light sources to the maximum predetermined level of illumination.

14. The apparatus as recited in claim 12, wherein the characteristic selected is a relatively constant color temperature, and the calculated amounts are determined by locating in the data sets the amount of illuminance of the first light source at the corresponding setting of the first changing means, and determining by reference to the data sets the amount of total illuminance needed from the second light source to restore the combined color temperature of both light sources to the predetermined color temperature.

15. A method of maintaining a relatively constant level of a light characteristic selected from one of a constant illumination level and a constant color temperature, comprising determining a series of data sets of the color temperature of at least first and second light sources at predetermined intervals of light levels of the light sources from a minimum predetermined level to a maximum predetermined level, creating a data base of the data sets, selecting a set level of illumination of the first light source to emit light at a selected color temperature for that light source locating in the data base the data set with that selected level of illumination of the first light source, changing the level of illumination of the first light source to change the color temperature of the first light source, locating in the data base the data set of at least the second light source that contains a level of illumination needed to restore the combined illumination to the desired constant characteristic, and exciting the second light source at that located illumination level.

16. A method according to claim 15 wherein the data base is contained in a programmable microprocessor and the steps of locating data sets, calculating levels of illumination and exciting the second lamp are managed by a computer program in the microprocessor.

17. A method according to claim 15 wherein the light sources are powered by alternating current with variations in phase delay angle to control the timing of applying voltage to the light sources to vary the illumination levels, and further comprising the step of determining the phase delay angles for the levels of illumination and including such phase delay angles as part of the data sets.

18. A method according to claim 15 wherein the characteristic selected is a relatively constant illumination level, and further comprising the steps of determining from the data sets the amount of reduced illuminance from a maximum predetermined illumination level of the first light source at other settings of the first changing means, and determining by reference to the data sets the amount of total illuminance needed from the second light source to restore the combined illumination level of both light sources to the maximum predetermined level of illumination of the first light source.

19. A method according to claim 15 wherein the characteristic selected is a relatively constant color temperature and wherein the step of selecting a set level of illumination of the first light source comprises the step of establishing a predetermined color temperature by exciting only the first light source, and further comprising the steps of determining from the data sets the amount of illuminance of the first light source at other levels of illumination of the first light source, and determining by reference to the data sets the amount of illuminance needed from the second light source to restore the combined color temperature of both light sources to the predetermined color temperature.

* * * * *